US011091312B2

(12) United States Patent
Tojo et al.

(10) Patent No.: US 11,091,312 B2
(45) Date of Patent: Aug. 17, 2021

(54) CONTAINER

(71) Applicant: OTSUKA TECHNO CORPORATION, Naruto (JP)

(72) Inventors: Kosuke Tojo, Tokushima (JP); Takaaki Nakao, Anan (JP); Hiroshi Ohno, Yokohama (JP); Shiho Fukaya, Tokyo (JP); Yoshio Hara, Anan (JP)

(73) Assignee: OTSUKA TECHNO CORPORATION, Naruto (JP)

( * ) Notice: Subject to any disclaimer, the term of this patent is extended or adjusted under 35 U.S.C. 154(b) by 30 days.

(21) Appl. No.: 16/328,905

(22) PCT Filed: Aug. 24, 2017

(86) PCT No.: PCT/JP2017/030237
§ 371 (c)(1),
(2) Date: Feb. 27, 2019

(87) PCT Pub. No.: WO2018/043265
PCT Pub. Date: Mar. 8, 2018

(65) Prior Publication Data

US 2019/0218015 A1 Jul. 18, 2019

(30) Foreign Application Priority Data

Aug. 30, 2016 (JP) ..... JP2016-167708

(51) Int. Cl.
*B65D 83/04* (2006.01)

(52) U.S. Cl.
CPC ..... *B65D 83/04* (2013.01); *B65D 2583/0481* (2013.01)

(58) Field of Classification Search
CPC ..... B65D 83/0409; B65D 83/0481; B65D 83/04; B65D 83/06; A61J 1/03; A61J 7/0076
(Continued)

(56) References Cited

U.S. PATENT DOCUMENTS 2,683,554 A * 7/1954 Mulhauser, Jr. ... B65D 83/0409 221/152
5,259,531 A 11/1993 Bennett
(Continued)

FOREIGN PATENT DOCUMENTS

DE 867 435 C 2/1953
EP 2 492 343 A3 4/1982
(Continued)

OTHER PUBLICATIONS

Extended European Search Report (EESR) dated Mar. 10, 2020 by the European Patent Office in corresponding European application No. 17846270.1.
(Continued)

*Primary Examiner* — King M Chu
(74) *Attorney, Agent, or Firm* — Sughrue Mion, PLLC

(57) ABSTRACT

A container (1) includes: a first storage section (11) for storing a plurality of solid objects (200); a second storage section (12) provided so as to be capable of being in communication with the first storage section (11) through a predetermined communication opening (50) and also so as to be capable of being in communication with an outside space (300) through a predetermined extraction opening (100); a tray (20) having a receiving section (80) which receives one solid object (200) supplied from the first storage section (11) to the second storage section (12), the tray (20) also having a first wall section (91) capable of closing the communication opening (50), the tray (20) further having a second wall section (92) capable of closing the extraction opening (100), the tray (20) being stored in the second storage section (12); and a movement mechanism (17) for sliding the tray (20) within the second storage section (12) between a first position at which the communication opening (50) is open and the extraction opening (100) is closed by the second wall section (92), and a second
(Continued)

position at which the communication opening (50) is closed by the first wall section (91) and the extraction opening (100) is open.

13 Claims, 28 Drawing Sheets

(58) Field of Classification Search
USPC ..... 221/233; 206/528; 222/336, 264, 361
See application file for complete search history.

(56) References Cited

U.S. PATENT DOCUMENTS

| | | | | |
|---|---|---|---|---|
| 6,948,634 | B2 * | 9/2005 | Evans | B65D 43/021 221/202 |
| 2017/0259985 | A1 | 9/2017 | Homma et al. | |

FOREIGN PATENT DOCUMENTS

| | | | |
|---|---|---|---|
| FR | 2 492 343 | A3 | 4/1982 |
| JP | 61-164174 | U1 | 10/1986 |
| JP | 2000-142841 | A | 5/2000 |
| JP | 2007-238128 | A | 9/2007 |
| JP | 2008-133000 | A | 6/2008 |
| JP | 2011-042380 | A | 3/2011 |
| WO | 2016/042887 | A1 | 3/2016 |

OTHER PUBLICATIONS

International Search Report dated Nov. 21, 2017, in counterpart International Application No. PCT/JP2017/030237.
International Preliminary Report on Patentability with translation of Written Opinion dated Mar. 5, 2019, in counterpart International Application No. PCT/JP2017/030237.

* cited by examiner

CONTAINER

CROSS REFERENCE TO RELATED APPLICATIONS

This application is a National Stage of International Application No. PCT/JP2017/030237 filed on Aug. 24, 2017, which claims priority from Japanese Patent Application No. 2016-167708 filed on Aug. 30, 2016.

TECHNICAL FIELD

The present invention relates to a container for housing solid materials such as tablets.

BACKGROUND ART

Conventionally, as a container for housing a plurality of tablets (such as tablet-shaped medicines and refreshing confectionery), flat containers in which tablets are housed without being stacked on each other in the thickness direction are known.

For example, as disclosed in Patent Document 1 and Patent Document 2, the takeout port of this type of container may be sized such that a plurality of tablets cannot pass at the same time, allowing tablets to be taken out one at a time.

PRIOR ART DOCUMENTS

Patent Documents

Patent Document 1: JP 2007-238128 A
Patent Document 2: JP 2008-133000 A

SUMMARY OF THE INVENTION

Problems to be Solved by the Invention

However, even if the size of the takeout port does not allow a plurality of tablets to pass simultaneously as described above, since a plurality of tablets may pass through the takeout port continuously, some structural devises are required so that only one tablet is reliably taken out.

For example, it is conceivable to provide a mechanism for providing a plurality of partitions for housing solid materials one by one in a container and for selectively aligning any one partition of these partitions to the takeout port, but in this case, the configuration of the container becomes complicated.

Thus, the present invention has an object to provide a container that can reliably take out solid materials such as tablets one by one while simplifying the configuration.

Means for Solving the Problems

In order to solve the above problem, a container according to one aspect of the present invention includes:

a first housing portion (11) configured to house a plurality of solid materials (200);

a second housing portion (12) configured to communicate with the first housing portion (11) via a predetermined communication port (50) and to be configured to communicate with an external space (300) via a predetermined takeout port (100);

a tray (20) housed in the second housing portion (12), the tray (20) including:

a receiving portion (80) configured to receive one of the solid materials (200) supplied from the first housing portion (11) to the second housing portion (12), a first wall portion (91) configured to block the communication port (50), and a second wall portion (92) configured to block the takeout port (100); and a movement mechanism (17) configured to move the tray (20) in a sliding manner between a first position in which the communication port (50) is opened and the takeout port (100) is blocked by the second wall portion (92) and a second position in which the communication port (50) is blocked by the first wall portion (91) and the takeout port (100) is opened in the second housing portion (12).

According to the present invention, in a state in which the tray is positioned at the first position in the second housing portion, when one of the solid materials supplied from the first housing portion to the second housing portion through the communication port is placed on the tray, and then the tray is moved to the second position in the second housing portion, instead of the takeout port of the second housing portion blocked by the first wall portion of the tray being opened, the communication port between the first housing portion and the second housing portion is blocked by the second wall portion of the tray. Thus, the solid material on the tray in the second housing portion is isolated from the other solid materials housed in the first housing portion, and further supply of the solid materials from the first housing portion to the second housing portion is prevented. Therefore, in a state in which the tray is positioned in the second position, only one solid material can be reliably taken out from the takeout port.

In addition, according to the present invention, even without providing a plurality of partitions for individually housing the solid materials or even without providing an alignment mechanism for selectively aligning any one partition of the partitions to the takeout port, the solid materials can be reliably taken out one by one, so that the configuration of the container can be simplified.

Furthermore, according to the present invention, when the solid material is taken out from the takeout port, since the tray is kept housed in the second housing portion, it is easy to maintain the sanitary condition of the tray favorably. Still furthermore, when the tray is positioned at the second position, since the communication port is blocked, it can be prevented that the solid material once taken out from the takeout port is returned to the first housing portion, or a foreign matter is mixed in the first housing portion.

In the present invention, the communication port (50) and the takeout port (100) may be arranged to face each other, and the second housing portion (12) may be provided with a slide restriction portion (131, 132) configured to restrict the solid material (200) on the receiving portion (80) from moving in a sliding manner in a sliding direction of the tray (20).

Thus, when the solid material is supplied from the first housing portion onto the tray in the second housing portion through the communication port, and then the tray is moved to the second position and the takeout port is opened, since the solid material whose slide movement is restricted by the slide restriction portion remains at a position between the communication port on the tray and the takeout port, the solid material can be taken out smoothly from the takeout port.

In this case, in the container according to the present invention, the receiving portion (80) may be provided with a deformation portion (81) brought into a predetermined deformed state only in a case where the solid material (200) is placed when the tray (20) moves in a forward direction (x2) from the first position to the second position, and the container may further include a slider (24) including an engaging portion (95) to be engaged with the deformation portion (81) only in a case where the deformation portion (81) is in the deformed state when the tray (20) moves in the forward direction (x2), the slider (24) being moved in a sliding manner in the forward direction together with the tray (20) in an engaged state of the engaging portion (95) and the deformation portion (81).

Thus, when the tray on which the solid material is placed moves in a sliding manner in the forward direction, since the deformation portion of the receiving portion of the tray is in a predetermined deformed state, and the slider engaged with the deformation portion in the deformed state also moves in a sliding manner in the forward direction together with the tray, the slide movement of the slider being detected by any sensor allows it to be checked that the solid material can be taken out from the takeout port.

On the other hand, in a state where no solid material is placed on the tray, the deformation portion does not deform even when the tray moves in the forward direction, and the slider is not engaged with the deformation portion, so that the slider does not move in a sliding manner together with the tray. Therefore, the movement of the slider is not detected when the tray without placing a solid material is moved in a sliding manner to the second position.

Therefore, based on the presence or absence of the slide movement of the slider, it can be checked accurately whether the solid material can be taken out from the takeout port.

In this case, in the container according to the present invention, the deformation portion (81) may be a tongue-shaped portion extending in a backward direction from the second position toward the first position with a predetermined portion of the receiving portion (80) as a base end to have a tip as a free end, the second housing portion (12) may include a separation restriction portion (120) arranged to face a placement surface (80*a*) of the solid material (200) in the receiving portion (80) to restrict the solid material (200) from moving in a direction of separating from the placement surface (80*a*), and in a state where the solid material (200) is placed on the tray (20) positioned at the first position, the tongue-shaped portion (81) may be provided with a first protruding portion (82) protruding toward the separation restriction portion (120) with respect to the placement surface (80*a*) at a position adjacent to the solid material (200) in the backward direction, and a second protruding portion (83) to be engaged with the slider (24) in the deformed state of the tongue-shaped portion (81), the second protruding portion (83) protruding opposite from the first protruding portion (82).

Thus, when the tray on which the solid material is placed moves in a sliding manner in the forward direction, the solid material whose slide movement is restricted by the slide restriction portion rides on the first protruding portion of the tongue-shaped portion in the receiving portion of the tray. At this time, since the solid material is restricted from moving in the direction separating from the placement surface of the receiving portion, the tongue-shaped portion is bent and deformed by the first protruding portion being pushed in by the solid material. Thus, the second protruding portion of the bent and deformed tongue-shaped portion is engaged with the slider, whereby the slider can move in a sliding manner in the forward direction together with the tray.

In this case, in the container according to the present invention, a surface on a front side (82*b*) in the forward direction in the first protruding portion (82) may be an inclined surface inclined to a side of the separation restriction portion (120) toward a back side in the forward direction.

Thus, when the tray on which the solid material is placed moves in a sliding manner in the forward direction, the relative movement of the solid material in the backward direction with respect to the tray is smoothly performed along the inclined surface on the front side in the first protruding portion of the tongue-shaped portion. Therefore, the solid material can be suppressed from being caught by the first protruding portion of the tongue-shaped portion, whereby the slide movement of the tray in the forward direction can be smoothly performed.

In this case, in the container according to the present invention, a surface on a back side (82*c*) in the forward direction in the first protruding portion (82) may be a non-inclined surface with respect to the forward direction, an inclined surface inclined to a side identical to a side of a surface on the front side (82*b*), or an inclined surface inclined opposite from the surface on the front side (82*b*) and having a steeper slope than the surface on the front side (82*b*).

Thus, when the tray on which the solid material is placed is to move in a sliding manner in the backward direction from the second position, a side surface on the back side in the first protruding portion of the tongue-shaped portion is caught by the solid material whose slide movement is restricted by the slide restriction portion. At this time, since the communication port is blocked by the first wall portion of the tray, the solid material is not returned to the first housing portion. Therefore, unless the solid material is taken out from the takeout port, the tray can be reliably restricted from returning to the first position, whereby the takeout of the solid material from the takeout port is prompted. Therefore, when the period of time or the number of times of dosage of the solid material, or the remaining number of solid materials in the container is managed based on the detection by the sensor, the accuracy of management of these can be enhanced.

In the present invention, each of the solid materials (200) may be a tablet having a flat shape, a dimension in a thickness direction of the tablet (200) in an internal space of the first housing portion (11) may be smaller than a thickness of two of the tablets (200), a peripheral wall (11*a*) of the first housing portion (11) may include a pair of guide surface portions (111, 112) extending parallel to each other from a peripheral edge portion of the communication port (50), and a space between the pair of guide surface portions (111, 112) may be larger than a width of one of the tablets (200) and smaller than a width of two tablets.

Thus, since only one tablet can enter a passage between the pair of guide surface portions communicating with the communication port at a time out of the tablets housed in the first housing portion, the plurality of tablets can be suppressed from being caught between the pair of guide surface portions to be fixed in the passage, whereby the tablets in the first housing portion can be smoothly guided to the communication port one by one.

In this case, in the container according to the present invention, the pair of guide surface portions (111, 112) may be respectively a first guide surface portion (111) and a second guide surface portion (112) extending in a supplying direction of the tablet to the communication port (50), and the second guide surface portion (112) may be formed to be longer than the first guide surface portion (111) in the supplying direction.

Thus, when the tablets in the first housing portion are guided to the passage between the first and second guide surface portions, the tablet received at a portion extended to a side opposite to a side of the communication port in the second guide surface portion with respect to the first guide surface portion can be smoothly guided to the passage along the second guide surface portion.

In this case, in the container according to the present invention, a peripheral wall (11*a*) of the first housing portion (11) may further include:

a third guide surface portion (113) extending in a direction at a right angle to the supplying direction from a base end in the supplying direction of the first guide surface portion (111) toward a side opposite to a side of the second guide surface portion (112), and a fourth guide surface portion (114) extending in the direction at a right angle from a base end in the supplying direction of the second guide surface portion (112) toward a side opposite to a side of the first guide surface portion (111).

Thus, the tablets in the first housing portion are once received by the third guide surface portion or the fourth guide surface portion, and then can be smoothly guided to the passage between the first and second guide surface portions.

A container according to another aspect of the present invention includes:

a first housing portion (11) configured to house a plurality of solid materials (200);

a second housing portion (12) provided to be configured to communicate with the first housing portion (11) via a predetermined communication port (50) and to be configured to communicate with an external space (300) via a predetermined takeout port (100), the second housing portion (12) being configured to house one of the solid materials (200);

an opening and closing mechanism (98) including a first wall portion (91) configured to block the communication port (50) and a second wall portion (92) configured to block the takeout port (100), the opening and closing mechanism (98) being configured to block the takeout port (100) with the second wall portion (92) when the first wall portion (91) opens the communication port (50), the opening and closing mechanism (98) being configured to block the communication port (50) with the first wall portion (91) when the second wall portion (92) opens the takeout port (100);

a lever (95) configured to perform a predetermined operation in an interlocked state with an operation of opening the takeout port (100) by the opening and closing mechanism (98); and a switch mechanism (99) configured to interlock the opening and closing mechanism (98) and the lever (95) only in a state in which the solid material (200) is housed in the second housing portion (12).

According to the container according to the other aspect, in a state in which the takeout port is blocked and the communication port is opened by the opening and closing mechanism, one solid material can be supplied from the first housing portion to the second housing portion while the solid material is prevented from erroneously being discharged from the takeout port, and thereafter, in a state in which the communication port is blocked and the takeout port is opened by the opening and closing mechanism, one solid material in the second housing portion can be taken out from the takeout port while the solid material is prevented from being further supplied from the first housing portion to the second housing portion.

Therefore, even without providing a plurality of partitions for individually housing the solid materials or even without providing an alignment mechanism for selectively aligning any one partition of the partitions to the takeout port, the solid materials can be reliably taken out one by one, so that the configuration of the container can be simplified. In addition, when a solid material is taken out from the opened takeout port, since the communication port is blocked, it can be prevented that the solid material once taken out from the takeout port is returned to the first housing portion, or a foreign matter is mixed in the first housing portion.

Furthermore, in a state where the solid material is housed in the second housing portion, since the lever performs a predetermined operation in conjunction with the operation in which the takeout port is opened by the opening and closing mechanism, the operation of the lever being detected by any sensor allows it to be checked that a solid material can be taken out from the takeout port in the open state.

On the other hand, in a state where no solid material is housed in the second housing portion, even if the takeout port is opened by the opening and closing mechanism, since the lever does not perform the above operation, it is possible to prevent the erroneous detection that the solid material can be taken out.

The container according to the other aspect may further include a receiving portion (80) on which the solid material (200) is placed in the second housing portion (12), the receiving portion (80) may include a deformation portion (81) configured to be deformed into a predetermined deformed state only in a state where the solid material (200) is placed, and the switch mechanism (99) may interlock the opening and closing mechanism (98) and the lever (95) via the deformation portion (81) in the deformed state.

Thus, since the opening operation of the takeout port by the opening and closing mechanism and the operation of the lever are interlocked via the deformation portion in a predetermined deformed state only when a solid material is placed on the receiving portion in the second housing portion, it is possible to accurately check whether a solid material can be taken out from the takeout port in the open state based on the presence or absence of operation of the lever.

In the container according to the other aspect, the opening and closing mechanism (98) may include a movement mechanism (17) configured to relatively moves the solid material (200) placed on the receiving portion (80) with respect to the receiving portion (80) in conjunction with an operation of opening the takeout port (100), a protruding portion (82) configured to be pushed down by the relatively moved solid material (200) may be provided on a surface (80*a*) on which the solid material (200) is placed in the deformation portion (81), and the deformed state may be a state in which at least a part of the deformation portion (81) is displaced in a direction opposite to a protruding direction of the protruding portion (82) when the solid material (200) during the relative movement passes over the protruding portion (82).

Thus, when the solid material placed on the receiving portion moves relatively with respect to the receiving portion in conjunction with the opening operation of the takeout port by the opening and closing mechanism, pushing down the protruding portion of the receiving portion by the solid material brings the receiving portion into a deformed state, and the lever is operated via the deformation portion in the deformed state. Therefore, detecting the operation of the lever with any sensor allows it to be checked that the solid material can be taken out from the takeout port in the open state.

Effects of the Invention

According to the present invention, the position of the tray on which the solid material to be supplied from the first housing portion to the second housing portion is placed is switched between the first position and the second position, which selectively opens any one of the communication port between the first housing portion and the second housing portion and the takeout port of the second housing portion, and closes the other. Therefore, solid materials in the container can be reliably taken out one by one while the configuration of the container is simplified.

EMBODIMENTS OF THE INVENTION

In the following, an embodiment according to the present invention will be described with reference to the accompanying drawings. It should be noted that in the following description, terms indicating specific directions and positions (for example, terms including "upper", "lower", "left", "right", "front surface", "back surface", "plane", "bottom surface", "lateral", "longitudinal", "thickness", "side", and "end") are used as necessary, but using these terms is to facilitate understanding of the invention with reference to the drawings, and the technical scope of the present invention is not limited by the meaning of the terms. In addition, the following description is, fundamentally, merely illustrative and is not intended to limit the present invention, products to which the present invention is applied, or applications of the present invention.

[Overall Configuration]

As shown in FIGS. 1 to 4C, a container 1 according to the present embodiment is a packaging container for housing solid materials such as tablets, and includes a container main body 4 for housing a plurality of solid materials, and an electronic module 2 detachably attached to the container main body 4.

Figure 4A:
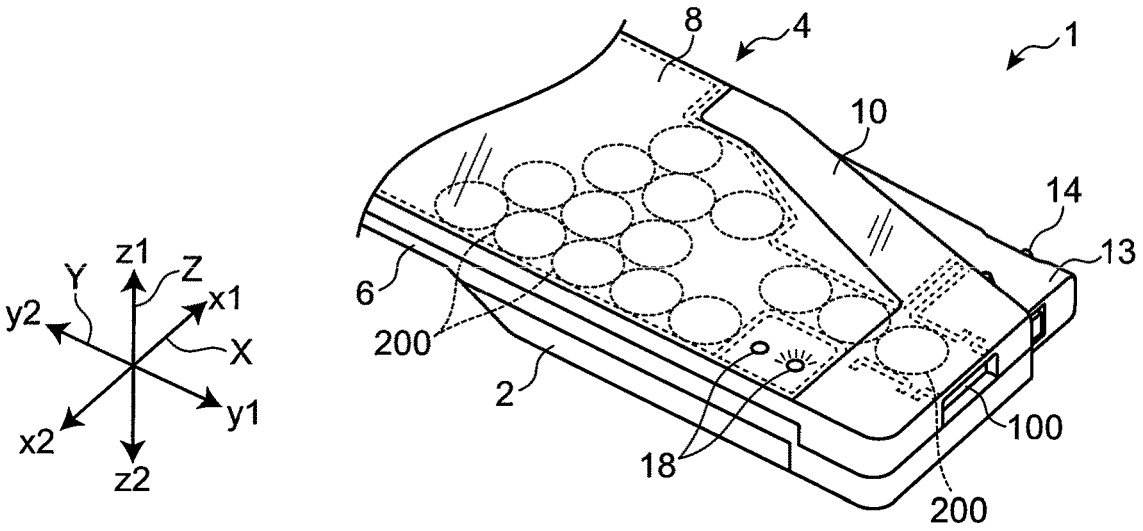
FIG. 4A is a first perspective view showing a usage state of the container.
Figure 4B:
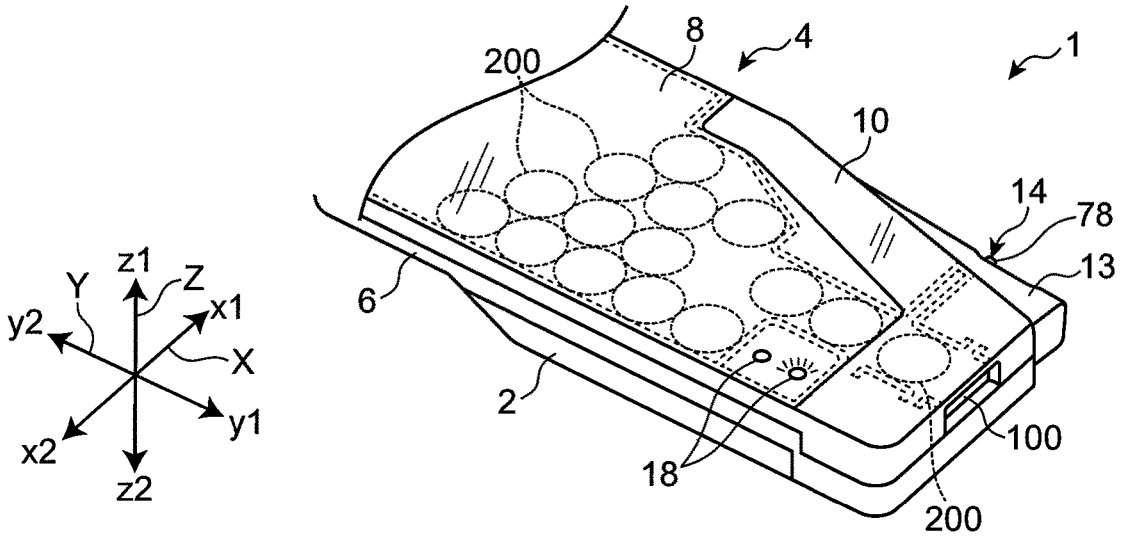
FIG. 4B is a second perspective view showing a usage state of the container.
Figure 4C:
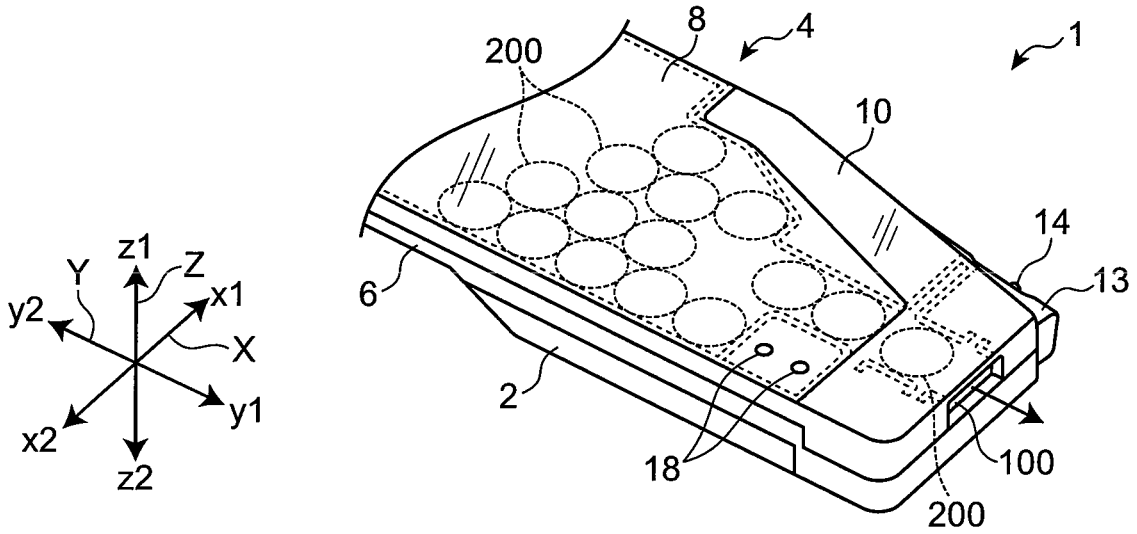
FIG. 4C is a third perspective view showing a usage state of the container.

In the present embodiment, the container main body 4 houses a plurality of tablets 200 (see FIGS. 4A-4C). Each of the tablets 200 housed in the container main body 4 is a flat solid material to be dosed, for example, as a medicine. However, the tablet 200 is not limited to a medicine, and may be food such as refreshing confectionery, for example. The shape of the tablet 200 is set to be, for example, circular, but the shape of the tablet 200 is not limited thereto.

The shape of the container main body 4 is set to be a flat rectangular shape having, for example, a pair of short sides extending in a "first direction X" and a pair of long sides extending in a "second direction Y" perpendicular to the first direction X. The thickness of the container main body 4 in a "third direction Z" perpendicular to the first direction X and the second direction Y is smaller than the length of the short side of the container main body 4.

Hereinafter, the first direction X is also referred to as "lateral direction X", the second direction Y as "longitudinal direction Y", and the third direction Z as "thickness direction Z".

In addition, in the following description, the surface on one side in the thickness direction Z of the container main body 4 is referred to as "front surface" (see the front view in FIG. 5), the surface on the other side in the thickness direction Z is referred to as "back surface" (see the back view in FIG. 6), the surface on one side in the lateral direction X is referred to as "left side surface" (see the left side view in FIG. 8A), the surface on the other side in the lateral direction X is referred to as "right side surface" (see the right side view in FIG. 8B), the surface on one side in the longitudinal direction Y is referred to as "upper surface" or "plane" (see the plan view in FIG. 7A), and the surface on the other side in the longitudinal direction Y is referred to as "lower surface" or "bottom surface" (see the bottom view in FIG. 7B).

Furthermore, in the following description, one side in the lateral direction X is also referred to as "left side x1", the other side in the lateral direction X is also referred to as "right side x2", one side in the longitudinal direction Y is also referred to as "upper side y1", the other side in the longitudinal direction Y is also referred to as "lower side y2", one side in the thickness direction Z is also referred to as "front surface side z1", and the other side in the thickness direction Z is also referred to as "back surface side z2".

Figure 1:
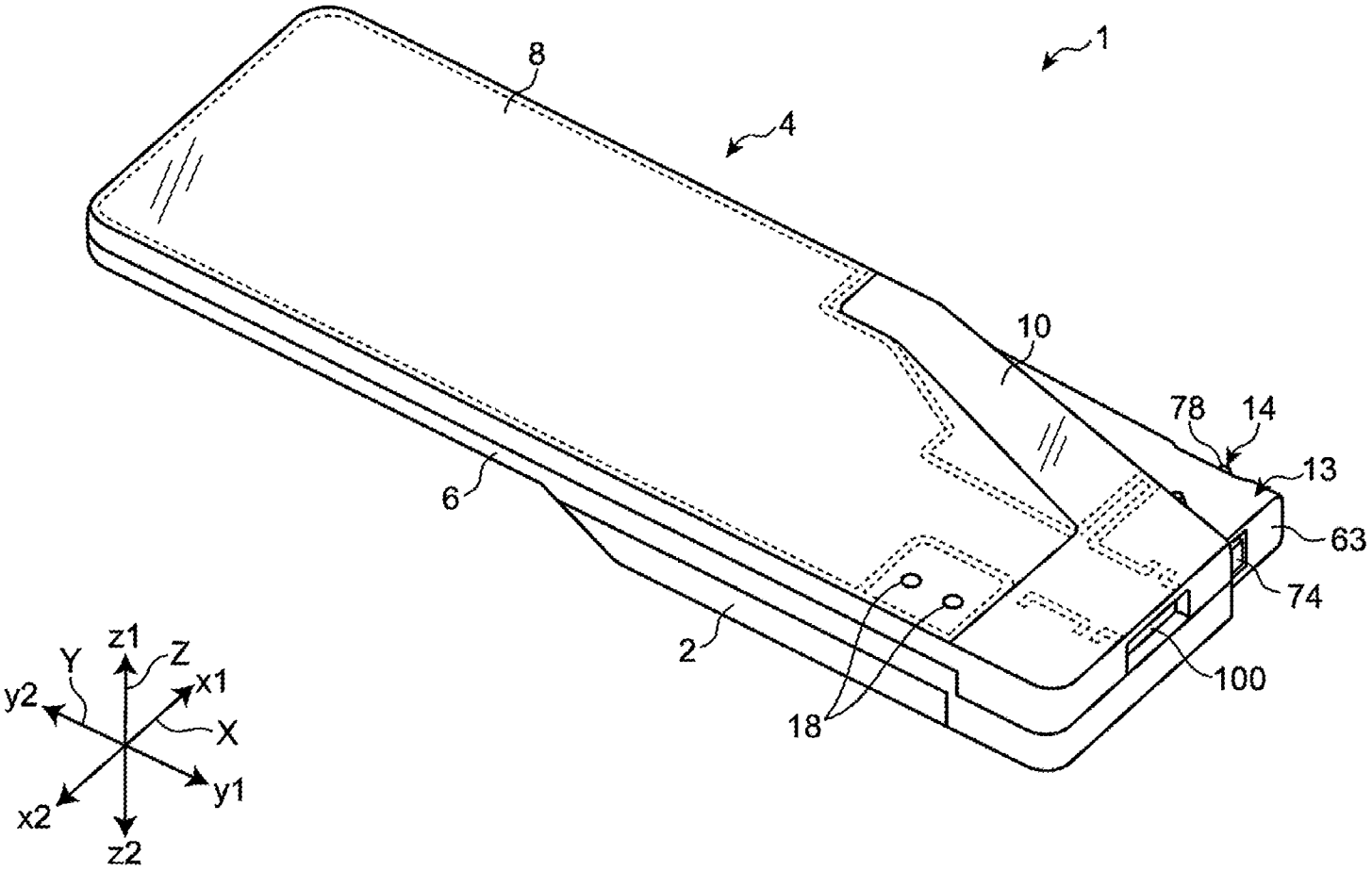
FIG. 1 is a perspective view showing a container according to an embodiment of the present invention.
Figure 7A:
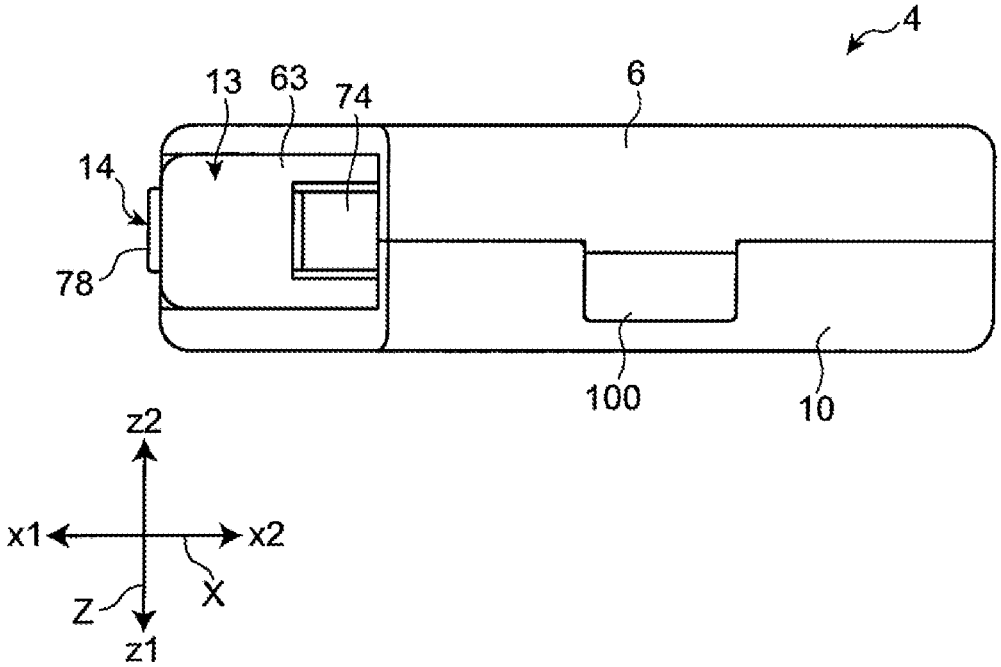
FIG. 7A is a plan view of the container main body.

As shown in the perspective view in FIG. 1 and the plan view in FIG. 7A, an openable and closable takeout port 100 is provided on the upper surface of the container main body 4, and the tablet 200 can be taken out from the takeout port 100 in the open state.

Figure 5:
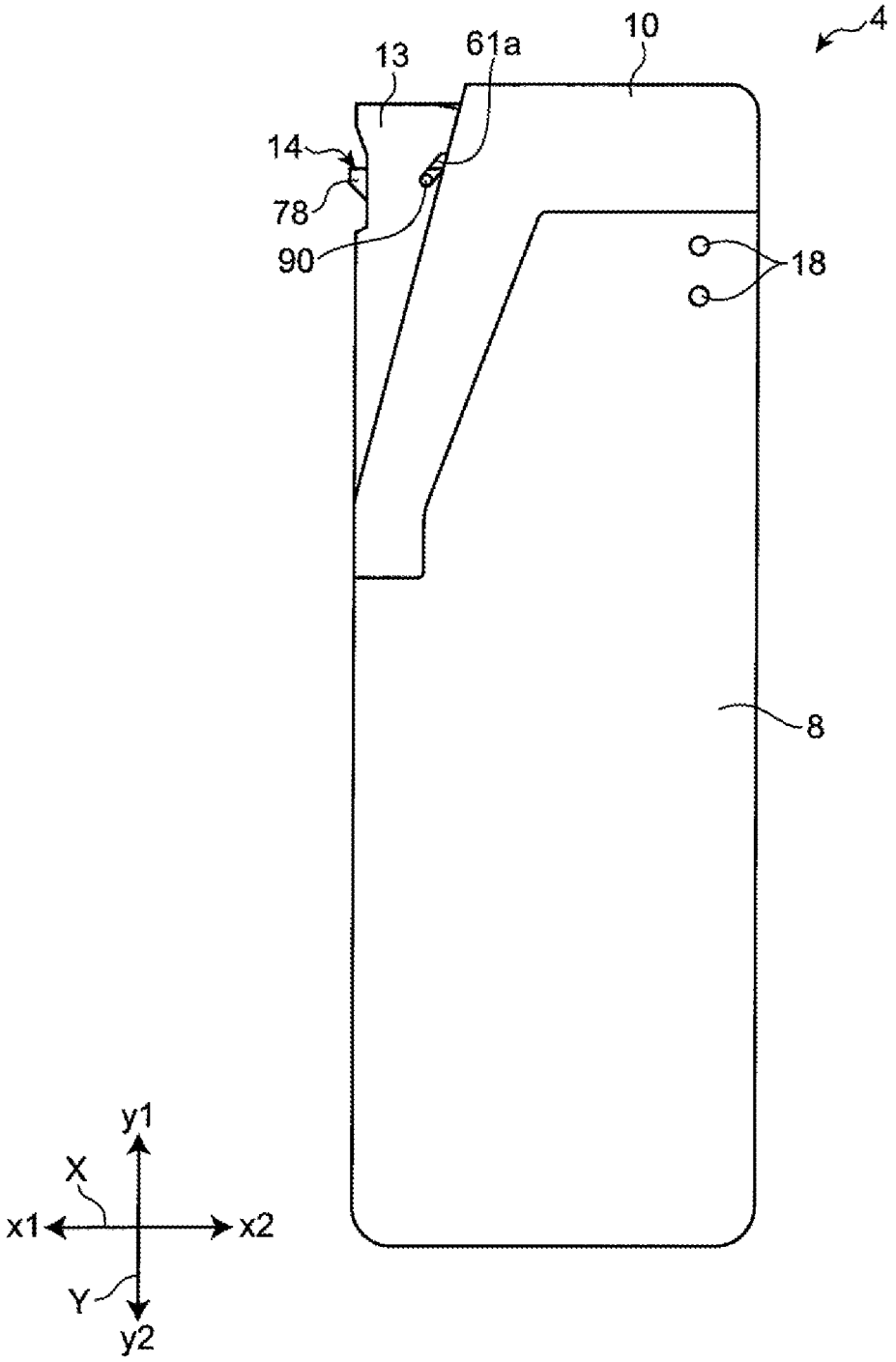
FIG. 5 is a front view of the container main body.

As shown in the perspective view in FIG. 1 and the front view in FIG. 5, notification units 18 for notifying by the blinking or lighting that it is the dosage time of the tablets 200 are provided on the front surface of the container main body 4. For example, one notification unit 18 is provided for the morning and one notification unit 18 is provided for the night, but the number of the notification units 18 may be one, or three or more. It should be noted that the notification mode by the notification unit 18 is not limited to blinking or lighting, and may be notified, for example, by displaying an image or sound.

Figure 2:
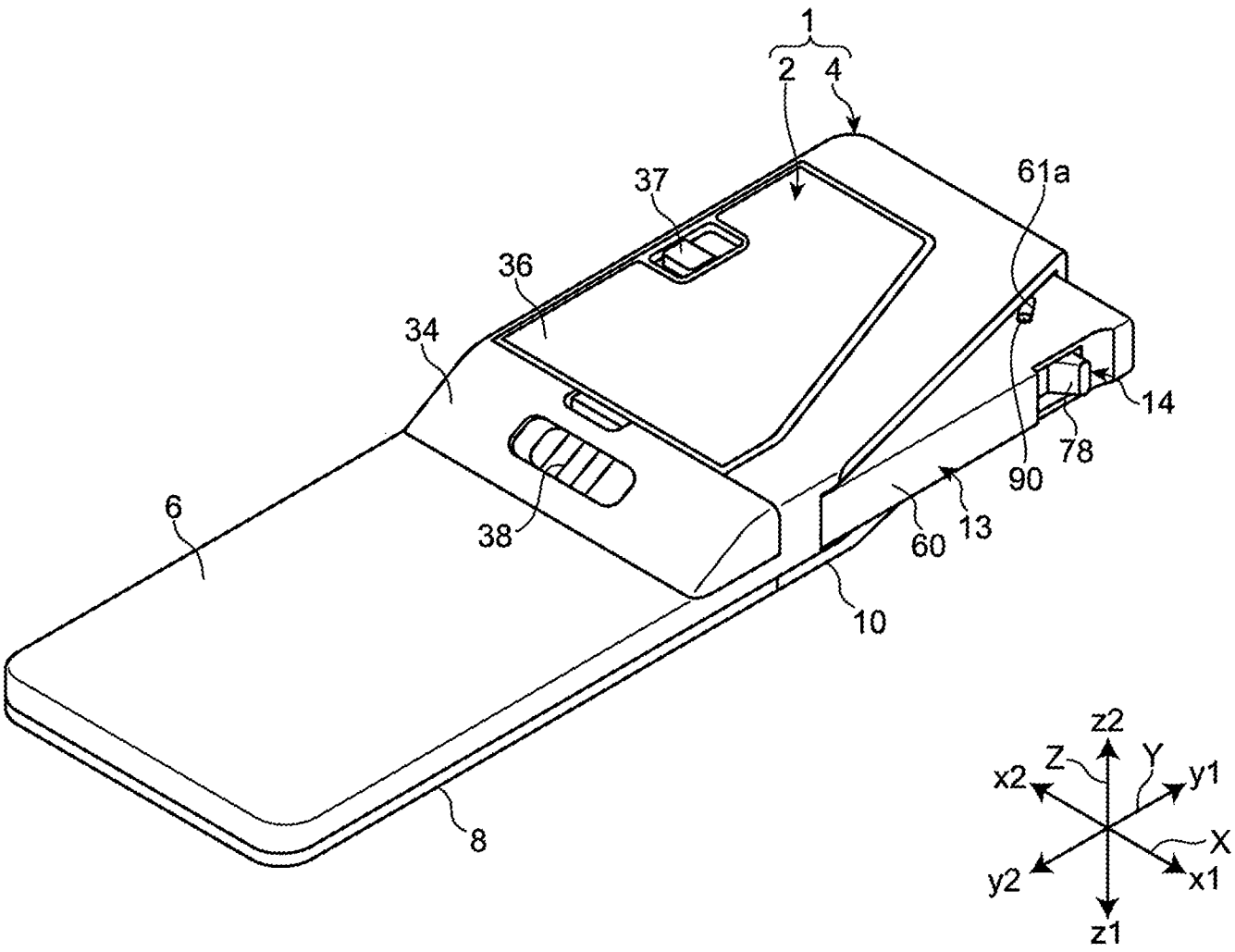
FIG. 2 is a perspective view of the container viewed from another direction.
Figure 8A:
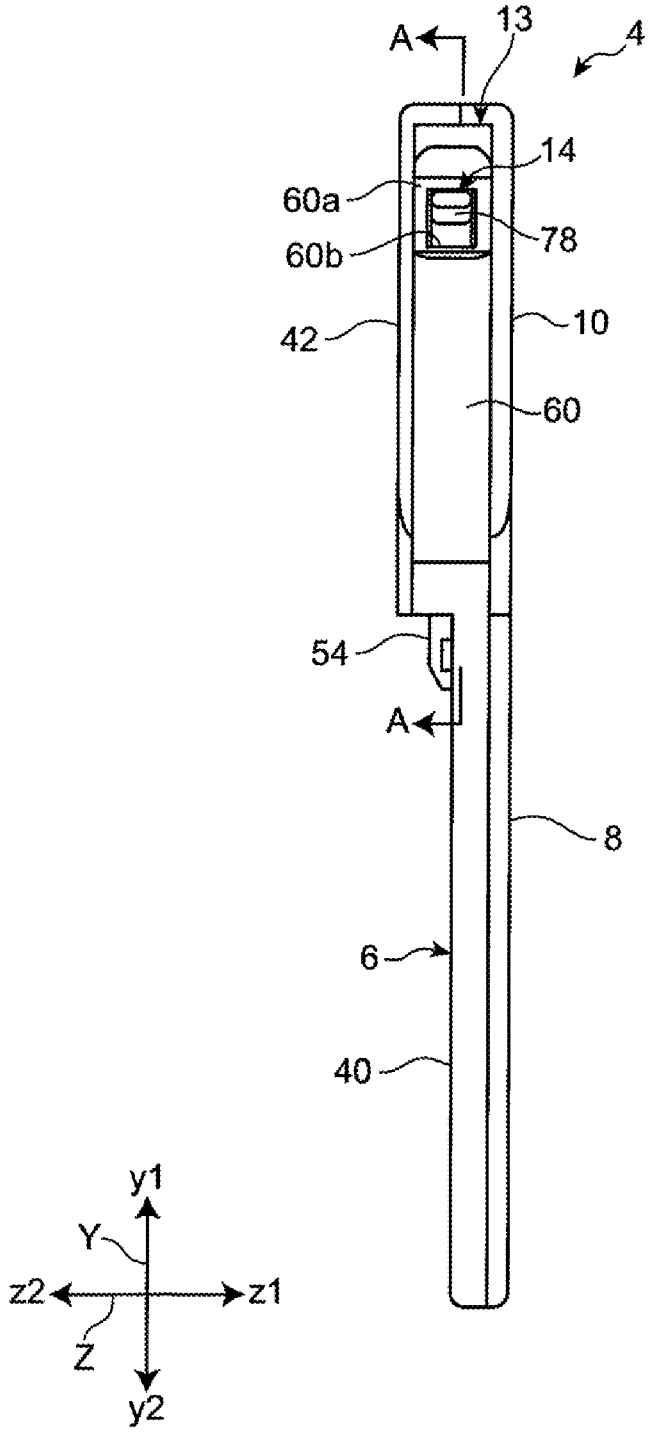
FIG. 8A is a left side view of the container main body.
Figure 8B:
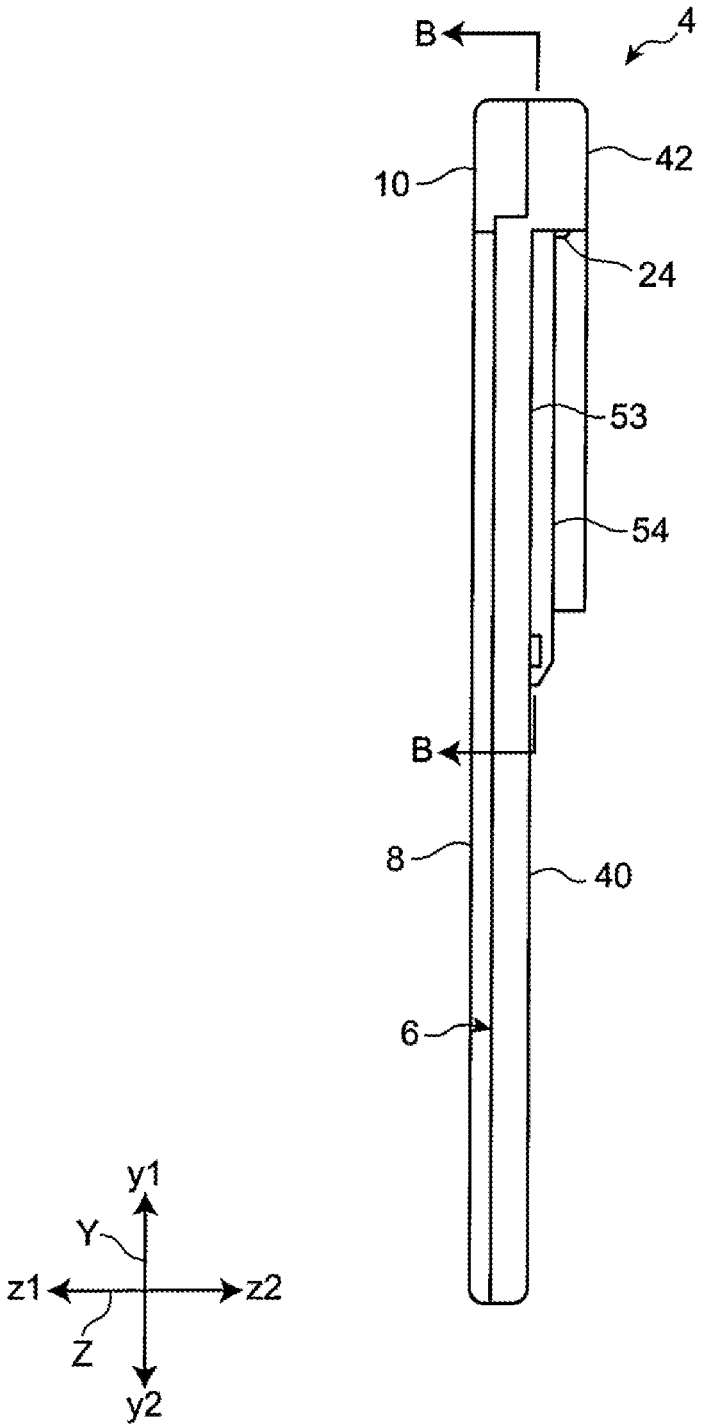
FIG. 8B is a right side view of the container main body.

As shown in the perspective views in FIGS. 1 and 2, the plan view in FIG. 7A, and the left side view in FIG. 8A, a knob 13 as an opening/closing operation portion is provided at the corner portion between the upper surface and the left side surface of the container main body 4, and operating the knob 13 allows the takeout port 100 to be opened and closed. A lock member 14 for locking the knob 13 is incorporated in the knob 13. The locking of the knob 13 with the lock member 14 can be released by the operation of a lock lever 78 exposed on the left side surface of the knob 13.

Figure 3:
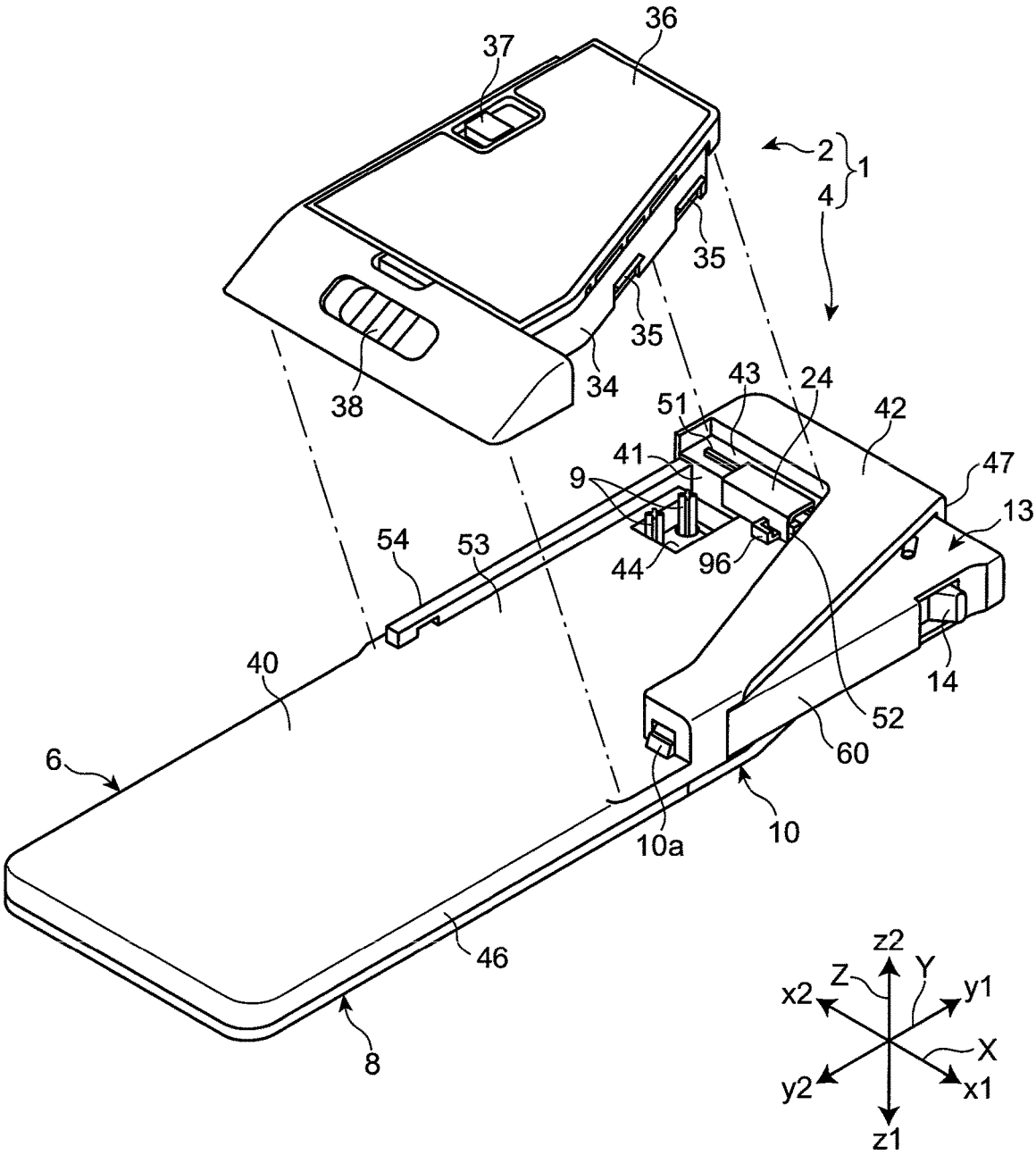
FIG. 3 is an exploded perspective view showing a container main body and an electronic module.
Figure 6:
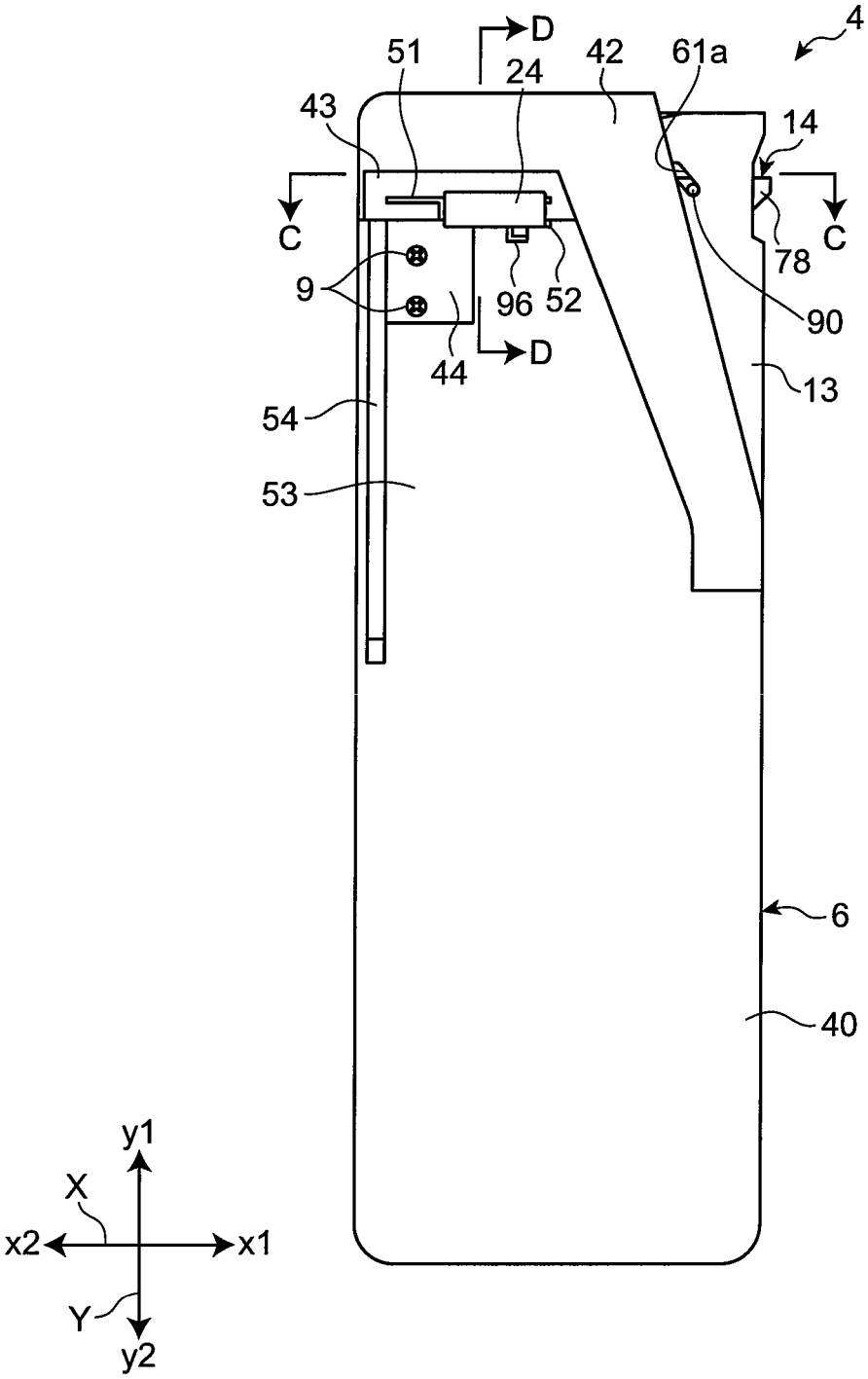
FIG. 6 is a back view of the container main body.
Figure 7B:
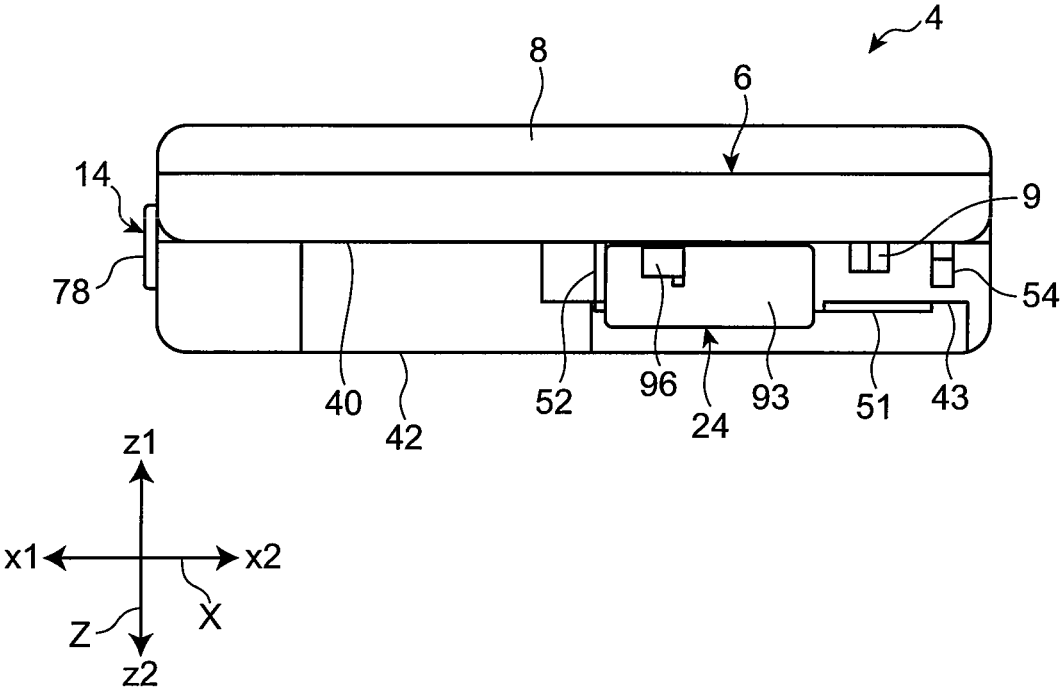
FIG. 7B is a bottom view of the container main body.

As shown in the exploded perspective view in FIG. 3 and the back view in FIG. 6, a module attached portion 53 is provided on the back surface of the container main body 4, and the electronic module 2 can be attached to the module attached portion 53 (see FIG. 2).

As shown in FIG. 3, the electronic module 2 includes a holder 34 for holding various kinds of electronic components, and a holder cover 36 for covering the surface on the back surface side of the holder 34. The holder 34 has a flat shape, and a plurality of engaging portions 35 to be engaged with the container main body 4 are provided on the peripheral edge portion of the holder 34.

The holder 34 holds a light emitting unit (not shown) including light emitting portions 31 such as LEDs (see FIG. 15) and a battery (not shown) as a power source of the light emitting unit. The blinking or lighting of the notification unit 18 is performed by using the irradiation light from the light emitting portion 31. In addition to the light emitting portion 31, the light emitting unit includes a microprocessor and a sensor 33 to be described below. These components of the light emitting unit are provided on one electronic circuit board, for example.

The electronic module 2 further includes an on/off switch 37 for turning on/off the light emitting portion 31 (see FIG. 15) and a lock switch 38 for switching between a locked state in which the electronic module 2 is locked in the attached state to the container main body 4 and an unlocked state in which the locked state is released.

Subsequently, a method for using the container 1 will be briefly described with reference to FIGS. 4A to 4C.

As shown in FIG. 4A, when the preset time comes, the notification unit 18 blinks or is lit to notify that it is the dosage time. According to this notification, a user taking the tablet 200 sets one of a plurality of tablets 200 housed in the container main body 4 at a predetermined position in the vicinity of the takeout port 100 by tilting the container main body 4 so that the upper surface side of the container main body 4 is lower than the lower surface side. At this time, since the takeout port 100 is closed, the tablet 200 does not accidentally come out from the takeout port 100.

Here, making the front surface of the container main body 4 of a transparent material or a translucent material allows the position of the tablet 200 in the container main body 4 to be visually recognized, whereby whether one tablet 200 is appropriately set at the predetermined position can be visually checked easily. It should be noted that when a seal describing various pieces of information and the like related to the tablet 200 is stuck on the front surface of the container main body 4, providing a window portion in the portion corresponding to the predetermined position in the seal allows the set state of the tablet 200 at the predetermined position to be checked.

As shown in FIG. 4B, the user checking that the tablet 200 is set at the predetermined position pushes the knob 13 to the right side x2 in the lateral direction X to open the takeout port 100. The operation of the knob 13 is performed in a state in which the lock of the knob 13 by the lock member 14 is released. Specifically, drawing the lock lever 78 of the lock member 14 to the lower side y2 in the longitudinal direction Y releases the lock of the knob 13, pushing and operating the knob 13 while maintaining this state.

As shown in FIG. 4C, opening the takeout port 100 with operating the knob 13 allows the tablet 200 to be taken out from the takeout port 100 by directing the takeout port 100 downward.

[Specific Configuration of Container Main Body]

A more specific configuration of the container main body 4 will be described with reference to a perspective view of each component shown in FIGS. 9 to 13 and cross-sectional views of the container main body 4 shown in FIGS. 14 to 17.

Figure 9:
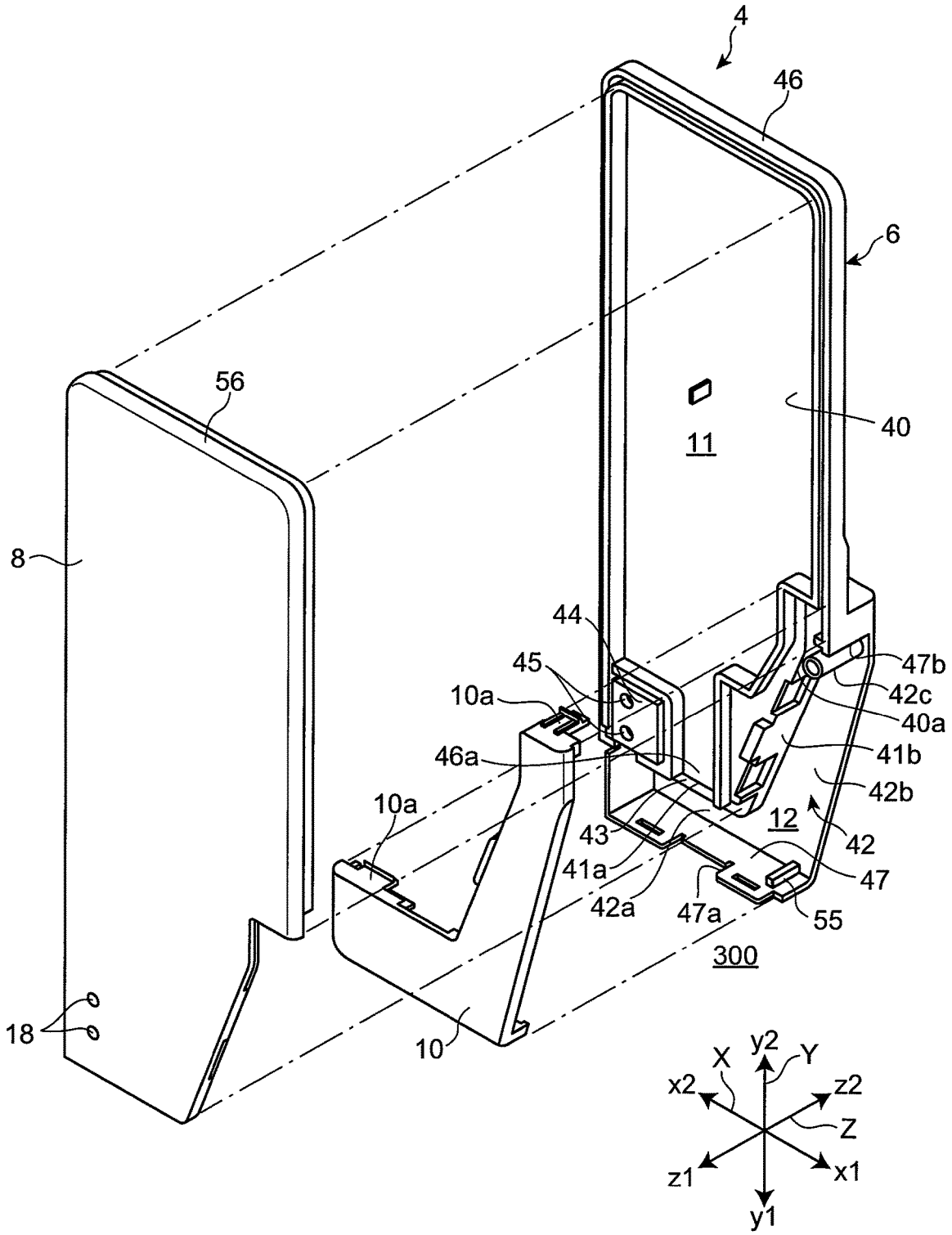
FIG. 9 is an exploded perspective view showing a main body, a main cover, and a sub cover.

As shown in FIG. 9, the container main body 4 includes a main body 6 constituting a back surface side portion of the container main body 4, and a main cover 8 and a sub cover 10 attached to the front surface side of the main body 6. The main body 6 is made of, for example, a colored resin material, and the main cover 8 and the sub cover 10 are made of, for example, a transparent or translucent resin material.

The main body 6 includes a main plate portion 40 and a sub plate portion 42 each of which is arranged at a right angle to the thickness direction Z.

The main plate portion 40 has a substantially rectangular shape elongated in the longitudinal direction Y, and a cutout 40*a* is formed at a corner portion of the main plate portion 40 on the left side x1 in the lateral direction X and on the upper side y1 in the longitudinal direction Y. A rail-shaped engaging portion 54 extending in the longitudinal direction Y is provided on the surface on the back surface side z2 of the main plate portion 40, and the electronic module 2 can be engaged with the engaging portion 54 (see FIG. 3).

The sub plate portion 42 is connected to the main plate portion 40 via a first connecting wall portion 41*a* extending from the edge portion on the upper side y1 of the main plate portion 40 to the back surface side z2 in the thickness direction Z, and a second connecting wall portion 41*b* extending from the portion along the cutout 40*a* of the main plate portion 40 to the back surface side z2 in the thickness direction Z. That is, the sub plate portion 42 is arranged closer to the back surface side z2 in the thickness direction Z than the main plate portion 40 is.

The sub plate portion 42 includes a lateral extension portion 42*a* extending in the lateral direction X along the edge portion on the upper side y1 of the main plate portion 40, and an inclined extension portion 42*b* extending in a direction inclined to the left side x1 from the end portion on the left side x1 toward the lower side y2 of the lateral extension portion 42*a* along the cutout 40*a* of the main plate portion 40.

The lateral extension portion 42*a* of the sub plate portion 42 is provided with a stage portion 43 protruding on the front surface side z1 in the thickness direction Z. The stage portion 43 extends in the lateral direction X along the edge portion on the upper side y1 of the main plate portion 40. The stage portion 43 is arranged closer to the back surface side z2 in the thickness direction Z than the main plate portion 40 is.

A tubular shaft portion 42*c* extending from the inclined extension portion 42*b* to the front surface side z1 in the thickness direction Z is provided in the vicinity of the lower side y2 end portion of the inclined extension portion 42*b* of the sub plate portion 42.

The main body 6 further includes a first peripheral wall portion 46 rising from the peripheral edge portion of the main plate portion 40 to the front surface side z1 in the thickness direction Z, and a second peripheral wall portion 47 rising from each of the edge portions of the upper side y1, the left side x1, and the right side x2 of the sub plate portion 42 to the front surface side z1 in the thickness direction Z.

The first peripheral wall portion 46 includes a cutout 46*a* at a portion along the edge portion on the upper side y1 of the main plate portion 40. The cutout 46*a* is arranged in the central portion of the container main body 4 in the lateral direction X.

The first peripheral wall portion 46 includes a light guiding guide portion 44 at a portion along the corner portion on the upper side y1 and the right side x2 of the main plate portion 40. The light guiding guide portion 44 is a plate-shaped portion arranged parallel to the main plate portion 40 and on the front surface side z1. A through hole 45 is provided at a position corresponding to the notification unit 18 (see FIGS. 1 and 4A-4C) in the light guiding guide portion 44.

The second peripheral wall portion 47 is connected to the first peripheral wall portion 46 at a portion along the right side x2 edge portion of the sub plate portion 42 and a portion along the left side x1 edge portion of the sub plate portion 42.

The second peripheral wall portion 47 includes cutouts 47*a* and 47*b* respectively in the portion along the upper side y1 edge portion and the portion along the left side x1 edge portion of the sub plate portion 42. The cutout 47*a* on the upper side y1 is formed at a position corresponding to the cutout 46*a* of the first peripheral wall portion 46 in the lateral direction X and the thickness direction Z. The cutout 47*b* on the left side x1 is formed from the upper side y1 end portion to the vicinity of the lower side y2 end portion of the sub plate portion 42 in the longitudinal direction Y and over the entire height of the second peripheral wall portion 47 in the thickness direction Z.

The main cover 8 is arranged to face the main plate portion 40 of the main body 6 and has a shape corresponding to the main plate portion 40. The main cover 8 includes a peripheral wall portion 56 rising from the peripheral portion thereof to the back surface side z2 in the thickness direction Z. The peripheral wall portion 56 has a shape corresponding to the first peripheral wall portion 46 of the main body 6 and is engageable with the first peripheral wall portion 46.

The main cover 8 is attached to the main body 6 with the peripheral wall portion 56 aligned with and engaged with the first peripheral wall portion 46 of the main body 6 over the entire periphery. Thus, a tablet housing portion 11 as a first housing portion is formed between the main plate portion 40 of the main body 6 and the main cover 8, and the plurality of tablets 200 are housed in the tablet housing portion 11. The configuration of the tablet housing portion 11 will be described below.

In the peripheral wall portion 56 of the main cover 8, a cutout 56*a* having a lateral direction X dimension corresponding to the cutout 46*a* (see FIG. 17) is formed at a position corresponding to the cutout 46*a* of the first peripheral wall portion 46 of the main body 6. Joining the cutout 46*a* of the first peripheral wall portion 46 opened to the front surface side z1 in the thickness direction Z and the cutout 56*a* of the peripheral wall portion 56 opened to the back surface side z2 together forms a communication port 50 (see FIG. 17) for communicating between the tablet housing portion 11 and a tray housing portion 12*a* described below.

The above notification unit 18 is provided on the surface of the front surface side z1 of the main cover 8. Light guide portions 9 extending toward the back surface side z2 in the thickness direction Z (see FIGS. 14 and 15) are integrally provided at positions corresponding to the notification units 18 of the main cover 8.

Figure 14:
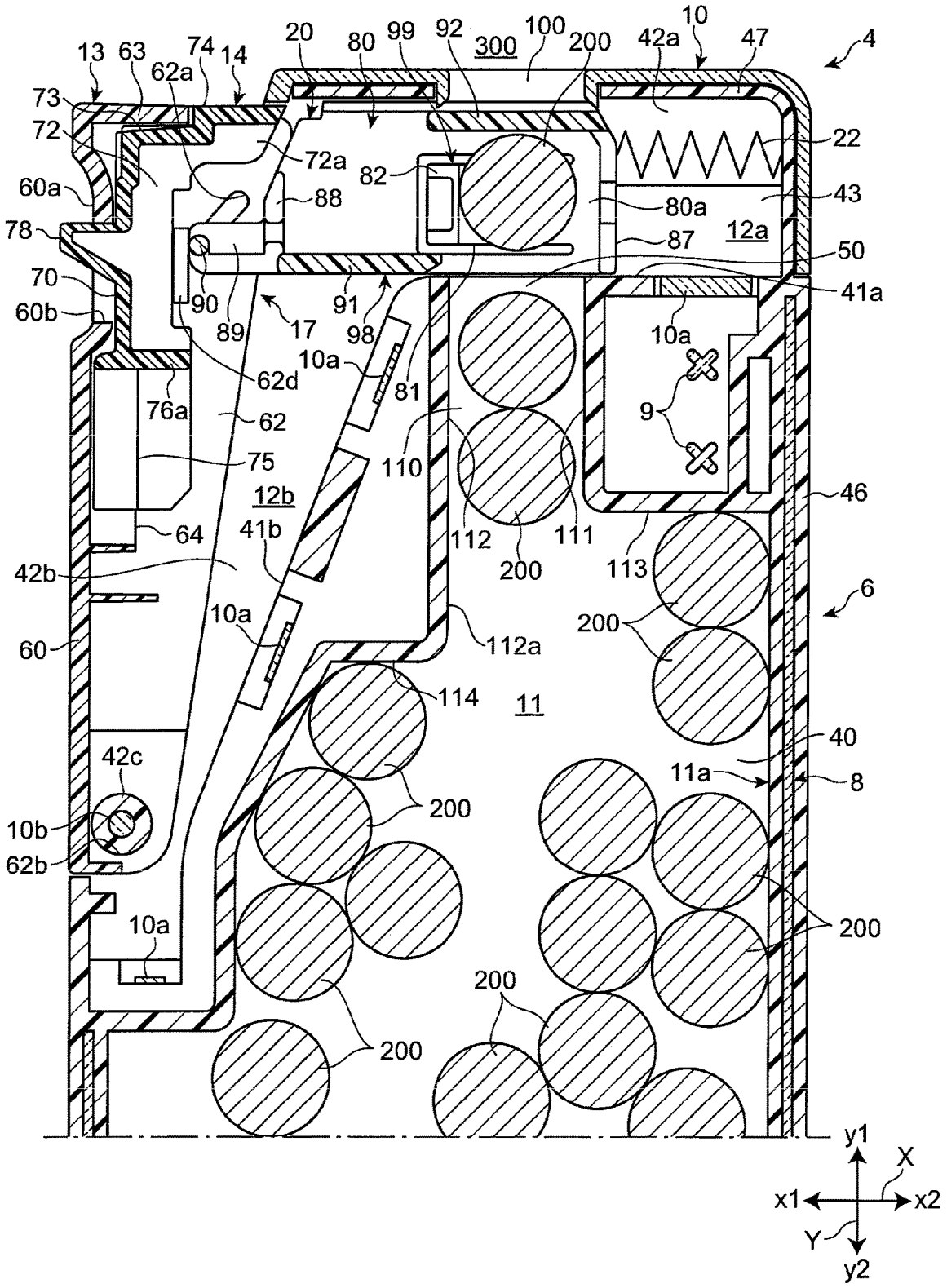
FIG. 14 is a cross-sectional view taken along line A-A in FIG. 8A as viewed from the front surface side of the inside of a first housing portion and a second housing portion.
Figure 15:
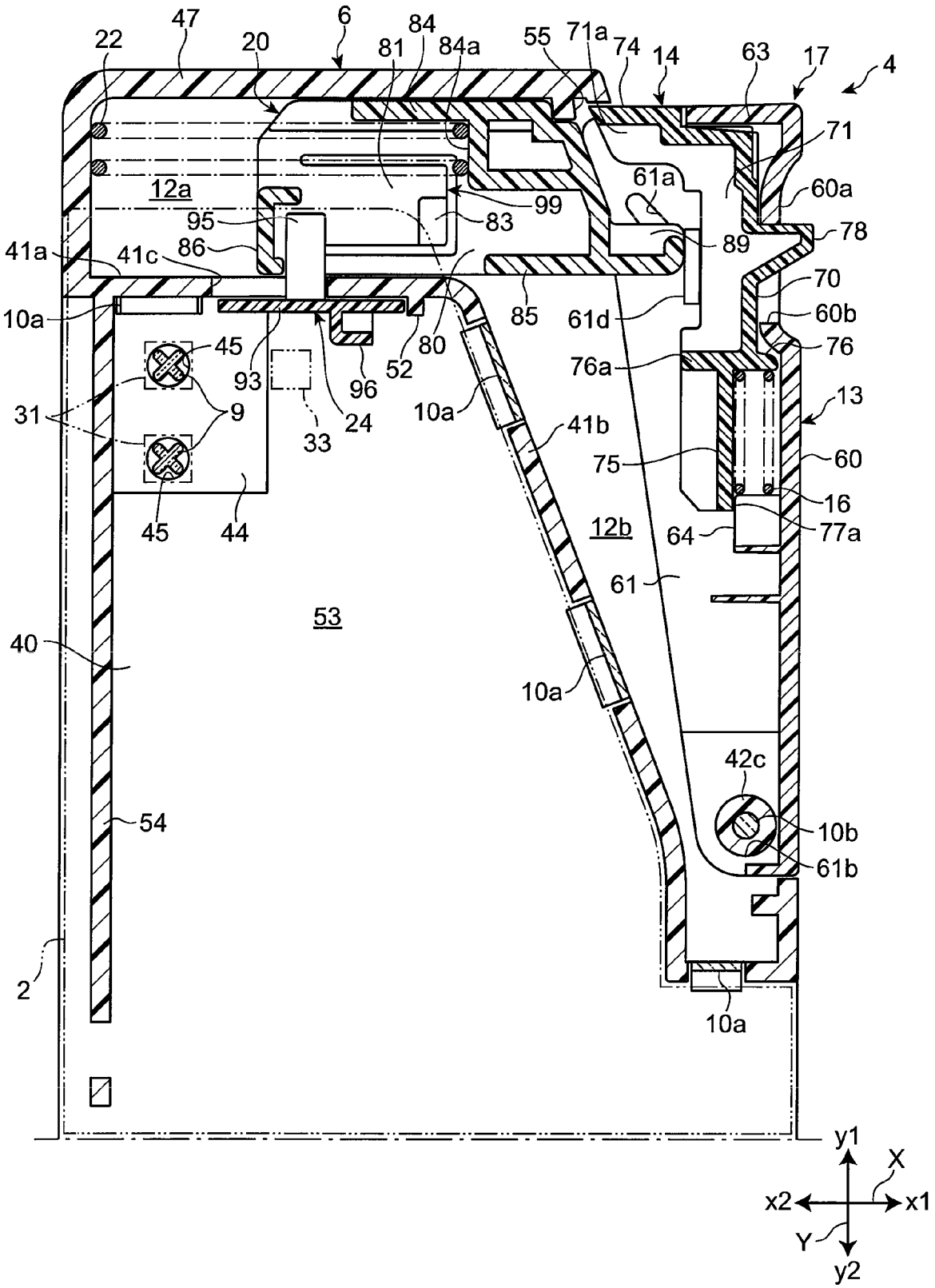
FIG. 15 is a cross-sectional view taken along line B-B in FIG. 8B as viewed from the back surface side of the inside of the second housing portion and a module attached portion.

As shown in FIGS. 14 and 15, each of the light guide portions 9 of the main cover 8 is arranged at a position corresponding to the through hole 45 of the light guiding guide portion 44 of the main body 6 in the lateral direction X and the longitudinal direction Y and is inserted through the corresponding through hole 45. The light guide portion 9 is formed, for example, in an X-shaped cross section. The tip of the light guide portion 9 is arranged to face the light emitting portion 31 of the electronic module 2. Thus, the light emitted from the light emitting portion 31 is guided to the notification unit 18 through the light guide portion 9.

As shown in FIG. 9, the sub cover 10 is arranged to face the sub plate portion 42 of the main body 6, and has a shape corresponding to the sub plate portion 42. A plurality of engaging claw portions 10*a* engageable with the main body 6 are provided in the peripheral edge portion of the sub cover 10.

An engaging shaft portion 10*b* (see FIGS. 14 and 15) extending to the back surface side z2 in the thickness direction Z is integrally provided at a position corresponding to the tubular shaft portion 42*c* of the main body 6 in the sub cover 10.

The edge portions of the upper side y1, the left side x1, and the right side x2 of the sub cover 10 are aligned with the second peripheral wall portion 47 of the main body 6, the sub cover 10 is engaged with a predetermined portion of the main body 6 at the engaging claw portion 10*a*, and the sub cover 10 is attached to the main body 6 in a state in which the engaging shaft portion 10*b* is fitted inside the tubular shaft portion 42*c* of the main body 6.

Thus, a component housing portion 12 as a second housing portion is formed between the sub plate portion 42 of the main body 6 and the sub cover 10. The component housing portion 12 has an internal space having a larger dimension in the thickness direction Z than that of the tablet housing portion 11. Thus, various components having dimensions larger than the dimension of the tablet 200 in the thickness direction Z can be housed in the component housing portion 12.

The component housing portion 12 includes the tray housing portion 12*a* for housing a tray 20 (see FIG. 12) described below, and a knob housing portion 12*b* for housing a part of the knob 13 (see FIG. 10) (see FIG. 14). The configurations of the tray housing portion 12*a* and the knob housing portion 12*b* will be described below.

The edge portion on the upper side y1 of the sub cover 10 is connected to the top of the second peripheral wall portion 47 of the main body 6. In the boundary portion between the upper side y1 edge portion of the sub cover 10 and the second peripheral wall portion 47 of the main body 6, the takeout port 100 (see FIGS. 1 and 4A-4C) is formed at a position corresponding to the cutout 47*a* of the second peripheral wall portion 47. The takeout port 100 and the communication port 50 are arranged so as to face each other with a space therebetween in the longitudinal direction Y (see FIG. 14).

[Tablet Housing Portion]

Figure 17:
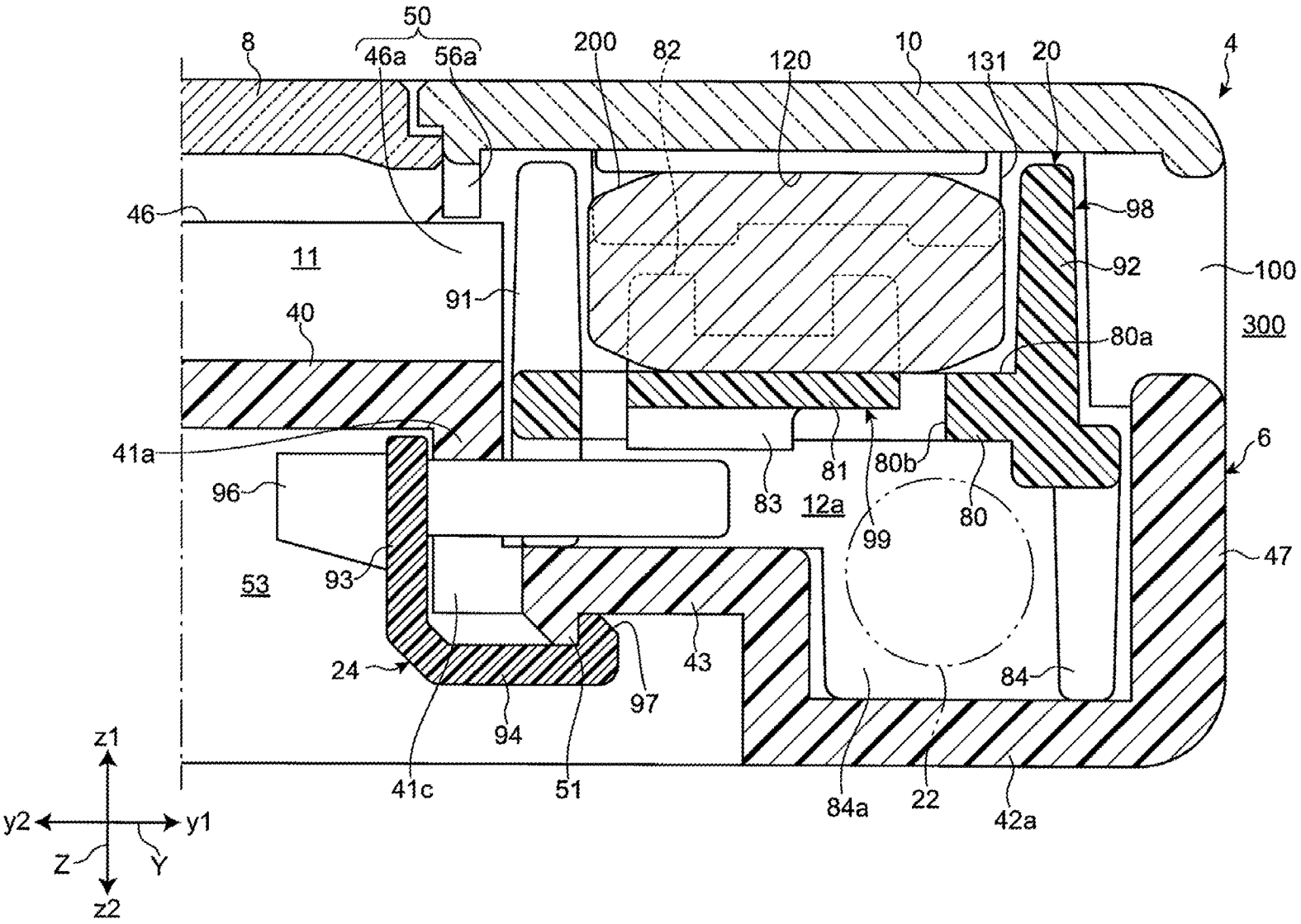
FIG. 17 is a cross-sectional view taken along line D-D in FIG. 6 when the slider and the peripheral portion thereof are viewed from the right side surface side.

As shown in FIG. 17, the tablet housing portion 11 formed between the main plate portion 40 of the main body 6 and the main cover 8 has such a dimension that it can house only one of the tablets 200 in the thickness direction Z. That is, the dimension in the thickness direction Z in the internal space of the tablet housing portion 11 is smaller than the thickness of two of the tablets 200, and is larger than the thickness of one of the tablets 200.

Thus, as shown in FIG. 14, the plurality of tablets 200 housed in the tablet housing portion 11 are arranged on substantially the same plane perpendicular to the thickness direction Z without stacking in the thickness direction Z.

The tablet housing portion 11 includes a peripheral wall 11*a* including the first peripheral wall portion 46 of the main body 6 and a peripheral edge portion of the main cover 8. The communication port 50 is provided at the end portion on the upper side y1 of the peripheral wall 11*a*. The communication port 50 has a size through which only one tablet 200 can pass.

The peripheral wall 11*a* has, on its inner surface, a first guide surface portion 111, a second guide surface portion 112, a third guide surface portion 113, and a fourth guide surface portion 114.

The first guide surface portion 111 and the second guide surface portion 112 are arranged so as to extend from the peripheral edge portion of the communication port 50 in parallel with each other. More specifically, the first guide surface portion 111 extends from the right side x2 edge portion of the communication port 50 toward the lower side y2 in the longitudinal direction Y, and the second guide surface portion 112 extends from the left side x1 edge portion of the communication port 50 toward the lower side y2 in the longitudinal direction Y. Thus, a passage 110 for guiding the tablet 200 in the tablet housing portion 11 to the communication port 50 along the supplying direction toward the upper side y1 in the longitudinal direction Y is formed between the first and second guide surface portions 111 and 112.

The space between the first and second guide surface portions 111 and 112 in the lateral direction X is larger than the width of one of the tablets 200 (the diameter of the tablet 200) and is smaller than the width of two of the tablet 200 (twice the diameter of the tablet 200). That is, the width of the above passage 110 has a size in which the plurality of tablets 200 cannot pass through side by side in the lateral direction X.

Thus, since only one tablet 200 can enter the passage 110 communicating with the communication port 50 at a time out of the tablets 200 housed in the tablet housing portion 11, the plurality of tablets 200 can be suppressed from being caught between the first and second guide surface portions 111 and 112 to be fixed in the passage 110, whereby the tablets 200 in the tablet housing portion 11 can be smoothly guided to the communication port 50 one by one.

The second guide surface portion 112 is formed to be longer than the first guide surface portion 111 in the longitudinal direction Y. That is, the second guide surface portion 112 includes an extension portion 112*a* projecting from the end portion on the lower side y2 of the first guide surface portion 111 to the lower side y2.

Thus, in the tablet housing portion 11, the tablets 200 moving toward the left side x1 in the lateral direction X and the tablets 200 moving in the direction inclined to the left side x1 in the lateral direction X toward the upper side y1 in the longitudinal direction Y can be received by the extension portion 112*a* of the second guide surface portion 112, and the tablet 200 received by the extension portion 112*a* can be smoothly guided to the passage 110 along the second guide surface portion 112.

The third guide surface portion 113 extends from the end portion on the lower side y2 of the first guide surface portion 111 to the right side x2 in the lateral direction X. Thus, a right-angled corner portion is formed between the first guide surface portion 111 and the third guide surface portion 113.

The fourth guide surface portion 114 extends from the end portion on the lower side y2 of the second guide surface portion 112 to the left side x1 in the lateral direction X. Thus, a right-angled corner portion is formed between the second guide surface portion 112 and the fourth guide surface portion 114.

Thus, on the lower side y2 with respect to the passage 110, the third and fourth guide surface portions 113 and 114 arranged at right angles to the passage 110 are provided, whereby the tablet 200 moving toward the upper side y1 in the longitudinal direction Y in the tablet housing portion 11 can be temporarily easily stopped by the third and fourth guide surface portions 113 and 114 positioned before the passage 110.

Thereafter, tilting the container 1 or the like allows the tablets 200 stopped by the fourth guide surface portion 114 to be smoothly guided to the passage 110 or the third guide surface portion 113, and the tablets 200 stopped by the third guide surface portion 113 to be smoothly guided to the passage 110 via the extension portion 112*a* of the second guide surface portion 112 or directly.

[Movement Mechanism]

The container main body 4 includes a movement mechanism 17 for moving the tray 20 described below in a sliding manner in the lateral direction X in the tray housing portion 12*a*. The movement mechanism 17 constitutes a part of an opening and closing mechanism 98 described below. The main component of the movement mechanism 17 is the knob 13 described in detail next.

[Knob]

Figure 10A:
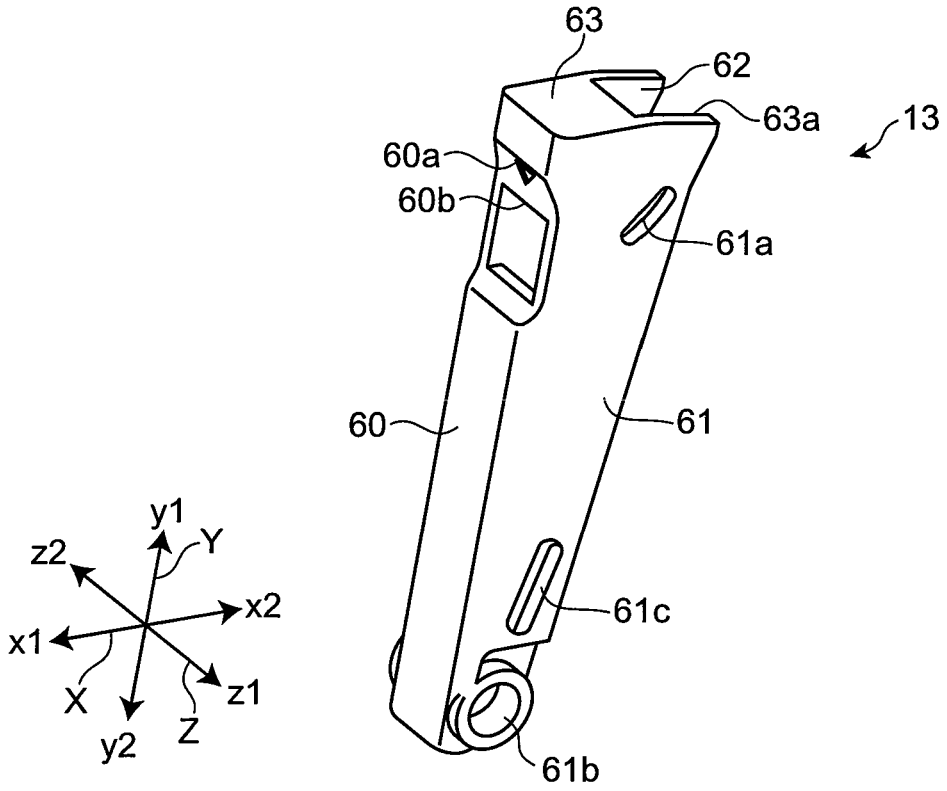
FIG. 10A is a first perspective view showing a knob.
Figure 10B:
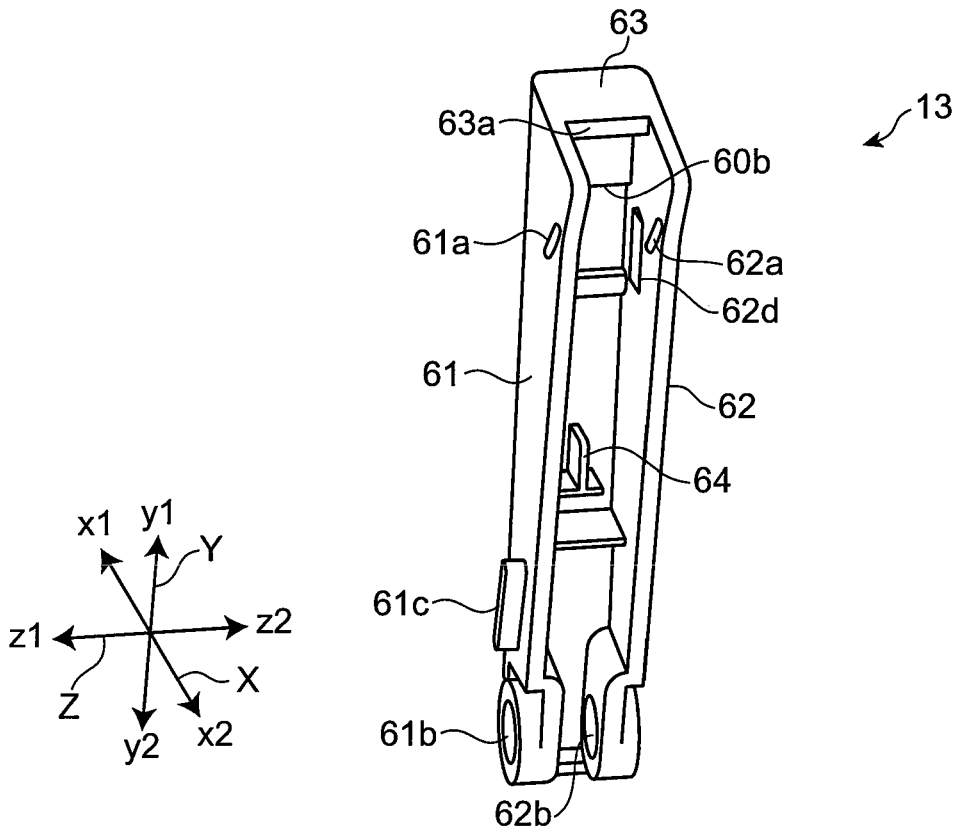
FIG. 10B is a second perspective view showing the knob.

As shown in FIGS. 10A and 10B, the knob 13 includes a side surface portion 60 arranged on the left side x1 side surface of the container main body 4, a front surface portion 61 extending from the edge portion of the front surface side z1 of the side surface portion 60 to the right side x2 in the lateral direction X, and a back surface portion 62 extending from the edge portion on the back surface side z2 of the side surface portion 60 to the right side x2 in the lateral direction X. Thus, the knob 13 is formed in a U-shaped cross section opened on the right side x2 in the lateral direction X as viewed from the longitudinal direction Y.

The side surface portion 60 is formed in a strip shape extending in the longitudinal direction Y. A recessed portion 60*a* is provided in the vicinity of the end portion on the upper side y1 of the side surface portion 60. In the recessed portion 60*a*, for example, a rectangular-shaped opening portion 60*b* is provided.

The front surface portion 61 and the back surface portion 62 are formed long in the longitudinal direction Y, and have shapes in which the dimensions in the lateral direction X are gradually enlarged toward the upper side y1 in the longitudinal direction Y. A part of the front surface portion 61 is arranged to face the back surface side z2 of the sub cover 10, and a part of the back surface portion 62 is arranged to face the front surface side z1 of the sub plate portion 42 of the main body 6. Thus, the knob 13 is positioned in the thickness direction Z by being sandwiched from both sides in the thickness direction Z by the main body 6 and the sub cover 10.

The front surface portion 61 and the back surface portion 62 are respectively provided with engagement holes 61*a* and 62*a* engaged with the tray 20, shaft holes 61*b* and 62*b* through which the tubular shaft portion 42*c* of the main body 6 is inserted, retaining portions 61*c* and 62*c* engaged with each left side x1 edge portion of the main body 6 and the sub cover 10, and engaging protrusions 61*d* and 62*d* engaged with the lock member 14.

The engagement holes 61*a* and 62*a* are provided in the vicinity of the upper side y1 end portion in the front surface portion 61 and the back surface portion 62. The engagement holes 61*a* and 62*a* are formed so as to extend in a direction inclined to the upper side y1 in the longitudinal direction Y toward the right side x2 in the lateral direction X.

The shaft holes 61*b* and 62*b* are provided in the vicinity of the lower side y2 end portion of the front surface portion 61 and the back surface portion 62. The tubular shaft portion 42*c* of the main body 6 is fitted inside the shaft holes 61*b* and 62*b*, whereby the knob 13 is supported by the main body 6 so as to be rotatable around the axis of the tubular shaft portion 42*c*.

The retaining portions 61*c* and 62*c* are ridge portions protruding outward in the thickness direction Z from the vicinity of the upper side y1 of the shaft holes 61*b* and 62*b* in the front surface portion 61 and the back surface portion 62. The retaining portions 61*c* and 62*c* are provided so as to extend in a direction inclined to the upper side y1 in the longitudinal direction Y toward the right side x2 in the lateral direction X. The retaining portions 61*c* and 62*c* are engaged with each the left side x1 edge portion of the main body 6 and the sub cover 10 from the right side x2, whereby the movement of the knob 13 to the left side x1 is restricted, resulting in the knob 13 being suppressed from coming off from a predetermined position.

The engaging protrusions 61*d* and 62*d* are ridge portions protruding from the inner surfaces of the front surface portion 61 and the back surface portion 62. The engaging protrusions 61*d* and 62*d* are provided so as to extend in the longitudinal direction Y in the vicinity on the left side x1 of the engagement holes 61*a* and 62*a*.

The knob 13 includes an end surface portion 63 at the end portion on the upper side y1 thereof. The end surface portion 63 is connected to the side surface portion 60 at the edge portion on the left side x1 thereof, to the front surface portion 61 at the edge portion on the front surface side z1, and to the back surface portion 62 at the edge portion on the back surface side z2. In the end surface portion 63, a cutout 63*a* opened to the right side x2 is formed.

A spring support portion 64 is disposed inside the knob 13. The spring support portion 64 is, for example, a rib-shaped portion projectingly provided from the inner surface of the side surface portion 60 to the right side x2 in the lateral direction X. The spring support portion 64 is arranged closer to the upper side y1 in the longitudinal direction Y than the shaft holes 61*b* and 62*b* are and closer to the lower side y2 in the longitudinal direction Y than the opening portion 60*b* is.

[Lock Member]

Figure 11A:
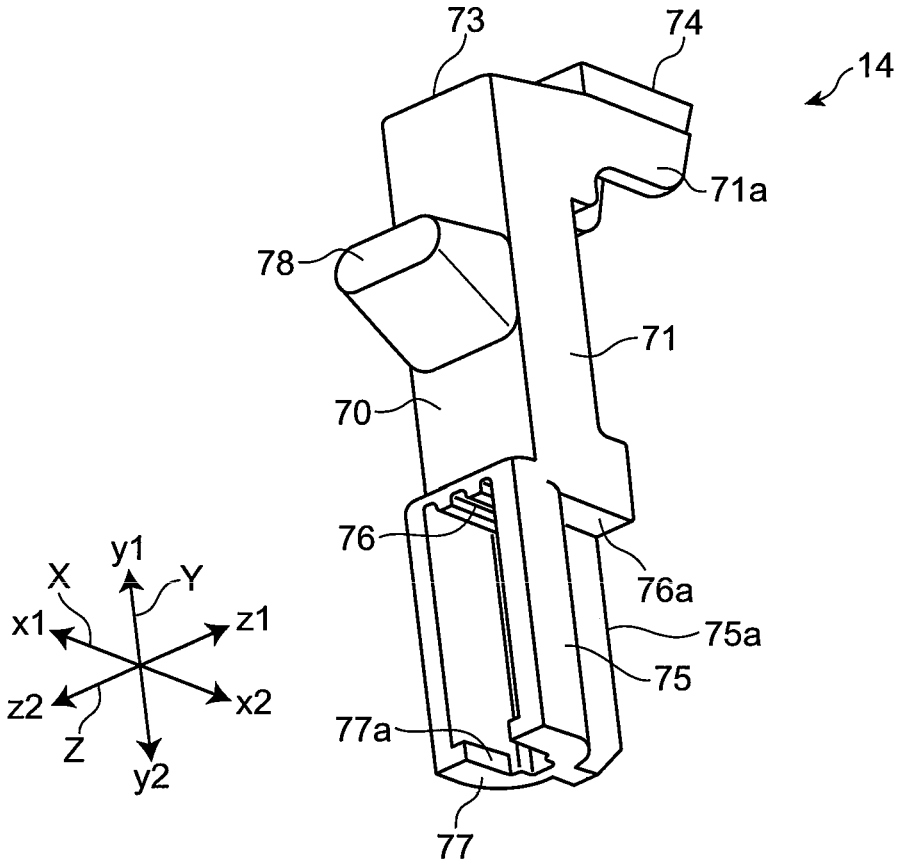
FIG. 11A is a first perspective view showing a lock member.
Figure 11B:
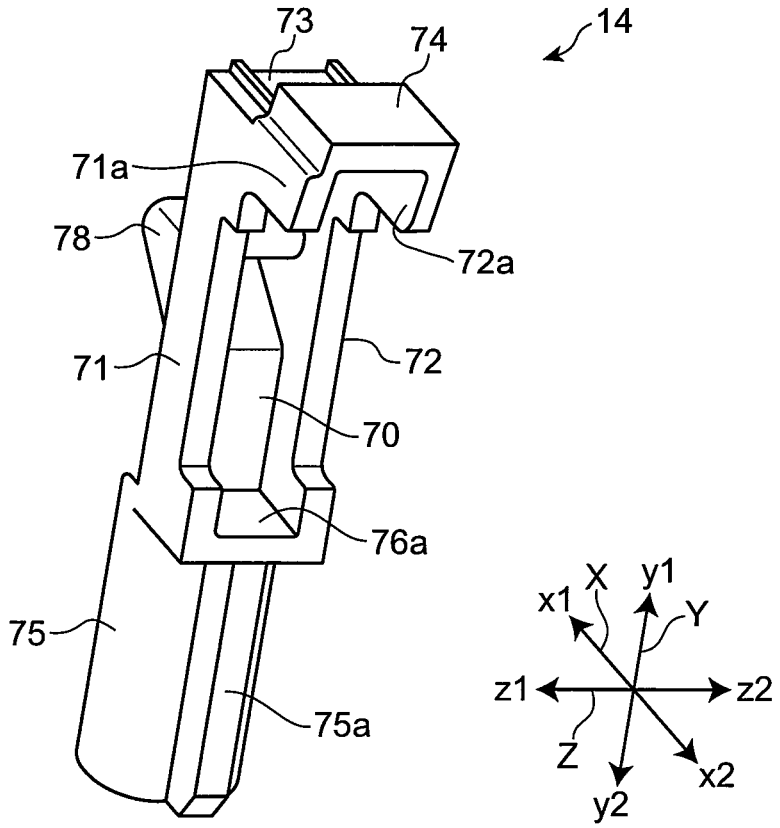
FIG. 11B is a second perspective view showing the lock member.

As shown in FIGS. 11A and 11B, the lock member 14 disposed inside the knob 13 includes a side surface portion 70 facing the inside of the side surface portion 60 of the knob 13, a front surface portion 71 facing the inside of the front surface portion 61 of the knob 13, a back surface portion 72 facing the inside of the back surface portion 62 of the knob 13, an end surface portion 73 facing the inside of the end surface portion 63 of the knob 13, and a spring housing portion 75 extending in the longitudinal direction Y from the lower side y2 end portion of the side surface portion 70 toward the lower side y2.

The side surface portion 70 is arranged to face the right side x2 of a portion where the recessed portion 60*a* in the side surface portion 60 of the knob 13 is provided. The lock lever 78 is provided protruding from the side surface portion 70 to the left side x1. The lock lever 78 is arranged to pass through the opening portion 60*b* of the knob 13 to penetrate the recessed portion 60*a* in the lateral direction X (see FIG. 2). The lock lever 78 is movable in a sliding manner in the longitudinal direction Y in the opening portion 60*b*. The tip of the lock lever 78 is arranged to protrude toward the left side x1 with respect to the surface of the side surface portion 60 of the knob 13 in the lateral direction X (see FIGS. 5 to 7).

The front surface portion 71 is provided so as to extend in the longitudinal direction Y along the edge portion on the front surface side z1 of the side surface portion 70, and in the end portion on the upper side y1 of the front surface portion 71, a front surface extension portion 71*a* extending to the right side x2 in the lateral direction X is provided. The back surface portion 72 is provided so as to extend in the longitudinal direction Y along the edge portion on the back surface side z2 of the side surface portion 70, and in the end portion on the upper side y1 of the back surface portion 72, a back surface extension portion 72*a* extending to the right side x2 in the lateral direction X is provided.

The edge portion on the upper side y1 of the front surface extension portion 71*a* and the edge portion on the upper side y1 of the back surface extension portion 72*a* are connected via an upper surface portion 74 arranged parallel to the end surface portion 73. The upper surface portion 74 is arranged closer to the upper side y1 than the end surface portion 73 is and is connected in a step-shape to the edge portion on the right side x2 of the end surface portion 73. During non-operation of the lock member 14, the upper surface portion 74 is arranged in the cutout 63*a* of the end surface portion 63 of the knob 13, and is arranged in substantially the same position as the end surface portion 63 of the knob 13 in the longitudinal direction Y (see FIG. 1).

The spring housing portion 75 is a semi-tubular portion having a semicircular cross section opened to the left side x1 in the lateral direction X. A first end surface portion 76 is provided at the end portion on the upper side y1 of the spring housing portion 75, and a second end surface portion 77 is provided at the end portion on the lower side y2 of the spring housing portion 75. In the first end surface portion 76, an extended surface portion 76*a* extended from the outer peripheral surface of the spring housing portion 75 to the right side x2 in the lateral direction X is provided. In the second end surface portion 77, a cutout 77*a* opening to the left side x1 is provided, and arranging the spring support portion 64 of the knob 13 (see FIG. 10B) in the cutout 77*a* avoids interference between the spring support portion 64 and the second end surface portion 77 (see FIG. 15).

A return spring 16 capable of expansion and contraction in the longitudinal direction Y (see FIG. 15) is disposed in the spring housing portion 75. The end portion on the upper side y1 of the return spring 16 is positioned in the longitudinal direction Y by the first end surface portion 76 of the spring housing portion 75, and the end portion on the lower side y2 of the return spring 16 is positioned by the spring support portion 64 of the knob 13.

The lock member 14 further includes a rib 75*a* protruding radially outward from the outer peripheral surface of the spring housing portion 75. The rib 75*a* is arranged at a right angle to the thickness direction Z. The rib 75*a* is provided so as to extend from the extended surface portion 76*a* of the first end surface portion 76 to the lower side y2 in the longitudinal direction Y.

[Knob Housing Portion]

As shown in FIGS. 14 and 15, the knob housing portion 12*b* includes a portion along the inclined extension portion 42*b* of the sub plate portion 42 of the main body 6, the second connecting wall portion 41*b*, and a left side x1 edge portion of the inclined extension portion 42*b* in the second peripheral wall portion 47, and a portion facing the inclined extension portion 42*b* in the sub cover 10.

The knob housing portion 12*b* is opened to the left side x1 in the cutout 47*b* of the second peripheral wall portion 47. The front surface portion 61 and the back surface portion 62 of the knob 13 are arranged in the cutout 47*b* of the second peripheral wall portion 47. Thus, a part on the right side x2 of the knob 13 is housed in the knob housing portion 12*b*, and a left side x1 opened portion of the knob housing portion 12*b* is blocked by the remaining portion of the knob 13 and the lock member 14. It should be noted that a left side x1 opened portion of the tray housing portion 12*a* described below is also similarly blocked by the knob 13 and the lock member 14.

The second connecting wall portion 41*b* constituting the knob housing portion 12*b* is arranged so as to extend in a direction inclined to the right side x2 in the lateral direction X toward the upper side y1 in the longitudinal direction Y. The right side x2 edge portions of the front surface portion 61 and the back surface portion 62 of the knob 13 are also similarly inclined, but the inclination thereof is gentle as compared with that of the second connecting wall portion 41*b*. Therefore, in the knob housing portion 12*b*, a space allowing the rotation of the knob 13 in the clockwise direction in FIG. 14 around the tubular shaft portion 42*c* is secured on the right side x2 of the knob 13 in the non-operation state.

[Tray]

Figure 12A:
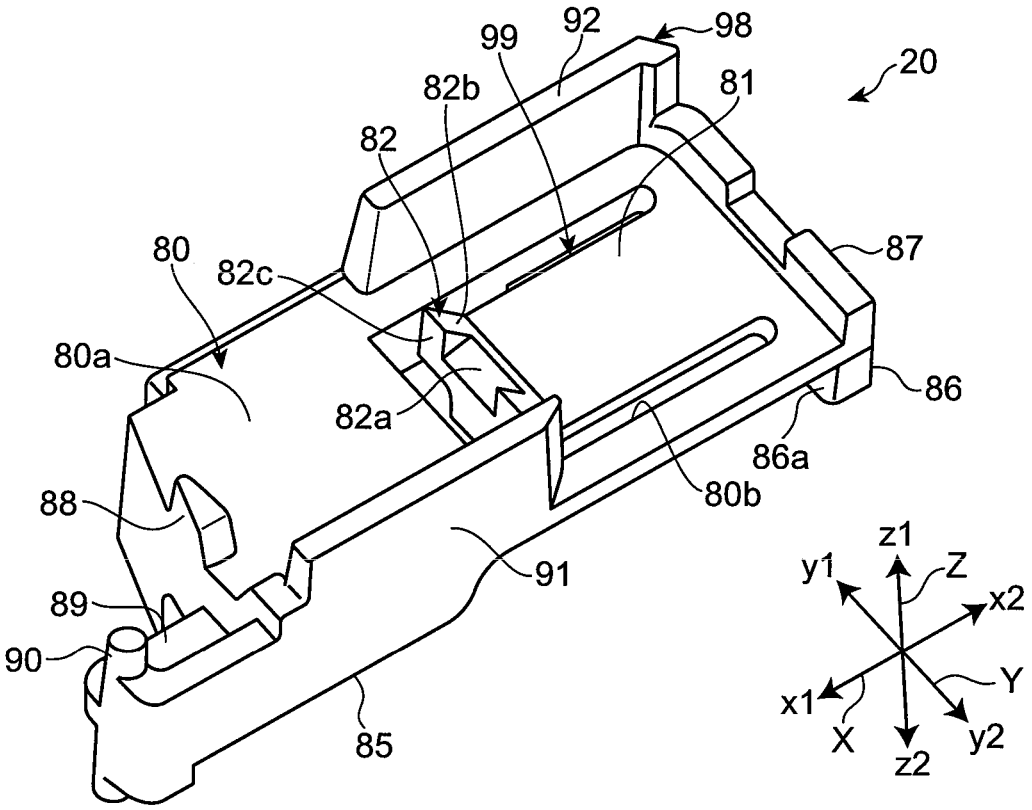
FIG. 12A is a first perspective view showing a tray.
Figure 12B:
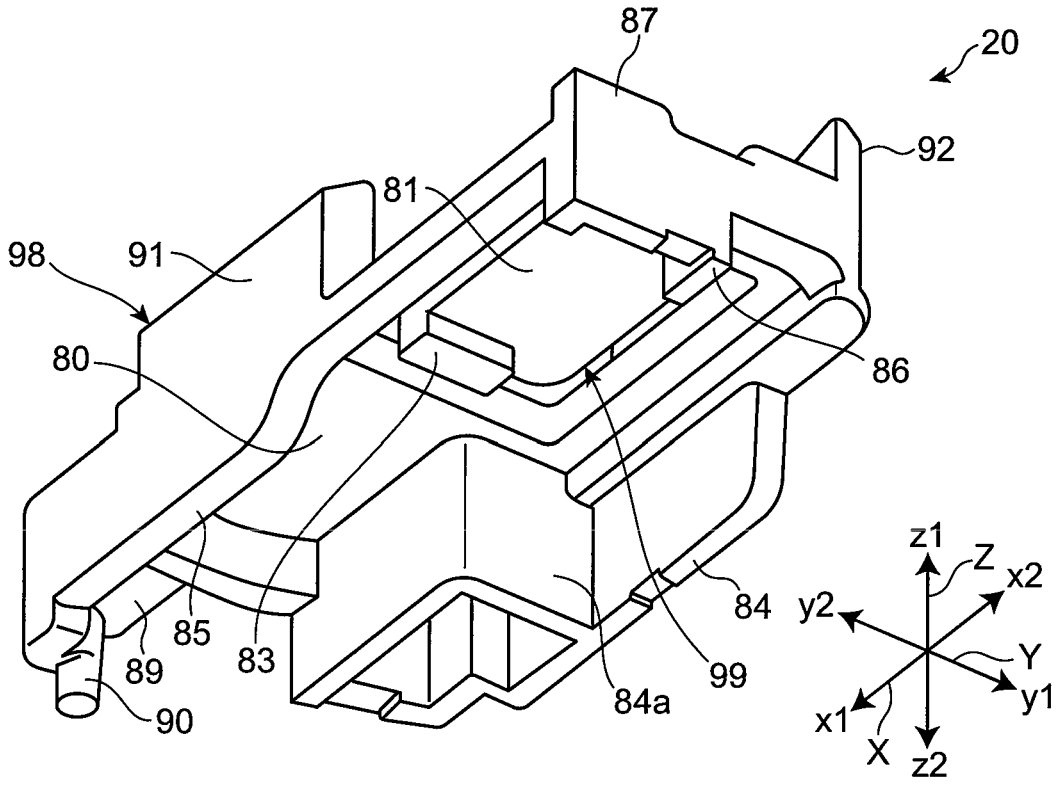
FIG. 12B is a second perspective view showing the tray.

As shown in FIGS. 12A and 12B, the tray 20 includes a receiving portion 80 for receiving tablets 200 supplied from the tablet housing portion 11 to the tray housing portion 12*a*. The receiving portion 80 is a plate portion arranged at a right angle to the thickness direction Z. The shape of the receiving portion 80 is a substantially rectangular shape having a pair of long sides extending in the lateral direction X and a pair of short sides extending in the longitudinal direction Y. The surface on the front surface side z1 in the thickness direction Z in the receiving portion 80 is a placement surface 80*a* on which the tablet 200 is placed.

The dimension in the lateral direction X of the receiving portion 80 is, for example, larger than the dimension of two of the tablets 200 (twice the diameter of the tablet 200) and is smaller than the dimension of three of the tablets 200 (three times the diameter of the tablet 200). The dimension in the longitudinal direction Y of the receiving portion 80 is, for example, larger than the dimension of one of the tablets 200 (the diameter of the tablet 200) and is smaller than the dimension of two of the tablets 200 (twice the diameter of the tablet 200).

A through hole 80*b* penetrating the receiving portion 80 in the thickness direction Z is provided in a portion ranging from the vicinity of the center in the lateral direction X to the vicinity of the right side x2 end portion in the receiving portion 80. The receiving portion 80 is provided with a tongue-shaped portion 81 having a tip as a free end, extending to the left side x1 in the lateral direction X with the right side x2 edge portion of the through hole 80*b* as a base end.

The surface on the front surface side z1 of the tongue-shaped portion 81 is arranged on the same plane as the placement surface 80*a* in a state where no external force is applied to the tongue-shaped portion 81. The tip of the tongue-shaped portion 81 is arranged substantially at the center of the receiving portion 80 in the lateral direction X.

In the tip portion of the tongue-shaped portion 81, a first protruding portion 82 protruding to the front surface side z1 in the thickness direction Z and a second protruding portion 83 protruding to the back surface side z2 are provided.

A cutout 82*a* is provided in a central portion in the longitudinal direction Y in the tip portion of the first protruding portion 82. A surface 82*b* on the right side x2 of the first protruding portion 82 is an inclined surface inclined to the front surface side z1 in the thickness direction Z toward the left side x1 in the lateral direction X. A surface 82*c* on the left side x1 of the first protruding portion 82 is a surface at a right angle to the lateral direction X. In the second protruding portion 83, any surface on the left side x1 and the right side x2 is arranged at a right angle to the lateral direction X.

The tray 20 further includes a first leg portion 84, a second leg portion 85, and a third leg portion 86 extending from the peripheral portion of the receiving portion 80 to the back surface side z2 in the thickness direction Z. The first leg portion 84 and the second leg portion 85 are plate portions arranged at right angles to the longitudinal direction Y, and the third leg portion 86 is a plate portion arranged at a right angle to the lateral direction X.

The first leg portion 84 is provided along the edge portion on the upper side y1 in the longitudinal direction Y in the receiving portion 80. The end surface on the back surface side z2 in the thickness direction Z in the first leg portion 84 is arranged to face the sub plate portion 42 of the main body 6 (see FIG. 17).

The first leg portion 84 is provided with a plate-shaped portion to be urged 84*a* protruding to the lower side y2 in the longitudinal direction Y. The portion to be urged 84*a* is arranged to face the edge portion on the right side x2 of the second peripheral wall portion 47 of the main body 6 across the return spring 22 capable of expansion and contraction in the lateral direction X (see FIG. 15). Thus, an urging force to the left side x1 in the lateral direction X by the return spring 22 acts on the portion to be urged 84*a*.

The second leg portion 85 is provided along the edge portion on the lower side y2 in the longitudinal direction Y in the receiving portion 80. The end surface on the back surface side z2 in the thickness direction Z in the second leg portion 85 is arranged to face the sub plate portion 42 or the stage portion 43 of the main body 6 according to the position of the tray 20 (see FIG. 16).

The third leg portion 86 is provided along the edge portion on the right side x2 in the lateral direction X in the receiving portion 80. The end surface on the back surface side z2 in the thickness direction Z in the third leg portion 86 is arranged to face the stage portion 43 of the main body 6 (see FIG. 16).

Regarding the protrusion amount from the receiving portion 80 to the back surface side z2, the protrusion amount of the first leg portion 84 is larger than the protrusion amounts of the second leg portion 85 and the third leg portion 86, and the protrusion amounts of the second leg portion 85 and the third leg portion 86 are equal to each other.

The tray 20 further includes a first positioning portion 87 extending from the right side x2 edge portion in the lateral direction X to the front surface side z1 in the thickness direction Z of the receiving portion 80, and a second positioning portion 88 extending from the left side x1 edge portion in the lateral direction X to the front surface side z1 in the thickness direction Z of the receiving portion 80.

The first positioning portion 87 is arranged to face the surface 82*b* on the right side x2 of the first protruding portion 82 of the tongue-shaped portion 81, and the second positioning portion 88 is arranged to face the surface 82*c* on the left side x1 of the first protruding portion 82.

The tray 20 further includes an extension portion 89 further extended from the edge portion on the left side x1 in the lateral direction X to the left side x1 of the receiving portion 80. The extension portion 89 is a plate portion arranged at a right angle to the thickness direction Z. At the tip portion on the left side x1 of the extension portion 89, a connecting shaft 90 extending in the thickness direction Z is provided so as to protrude to the front surface side z1 and the back surface side z2.

As shown in FIGS. 14 and 15, the connecting shaft 90 is engaged with the engagement hole 61*a* of the front surface portion 61 of the knob 13 on one end side thereof, and is engaged with the engagement hole 62*a* of the back surface portion 62 of the knob 13 on the other end side. The connecting shaft 90 is movable relative to the engagement holes 61*a* and 62*a* being elongated holes in the length range of the engagement holes 61*a* and 62*a*.

The tray 20 further includes a first wall portion 91 extending from the upper side y1 edge portion in the longitudinal direction Y to the front surface side z1 in the thickness direction Z in the receiving portion 80, and a second wall portion 92 extending from the lower side y2 edge portion in the longitudinal direction Y to the front surface side z1 in the thickness direction Z in the receiving portion 80. The first wall portion 91 and the second wall portion 92 are plate portions arranged at right angles to the longitudinal direction Y.

The first wall portion 91 is provided from the left side x1 edge portion to the central portion of the receiving portion 80 in the lateral direction X. The first wall portion 91 has a dimension larger than that of the communication port 50 in the lateral direction X and can block the communication port 50 (see FIG. 20).

The second wall portion 92 is provided from the central portion to the right side x2 edge portion of the receiving portion 80 in the lateral direction X. The second wall portion 92 has a dimension larger than that of the takeout port 100 in the lateral direction X and can block the takeout port 100 (see FIG. 14).

Thus, the first wall portion 91 and the second wall portion 92 constitute a part of the opening and closing mechanism 98 for opening and closing the communication port 50 and the takeout port 100.

As shown in FIG. 14, the first wall portion 91 and the second wall portion 92 are arranged to overlap with each other in the lateral direction X. The first wall portion 91 is arranged to overlap with the first protruding portion 82 of the tongue-shaped portion 81 and the second positioning portion 88 in the lateral direction X. The second wall portion 92 is arranged to overlap with the first protruding portion 82 of the tongue-shaped portion 81 and the first positioning portion 87 in the lateral direction X.

[Tray Housing Portion]

As shown in FIGS. 14 to 17, the tray housing portion 12*a* includes a portion along the lateral extension portion 42*a* of the sub plate portion 42 of the main body 6, the stage portion 43, the first connecting wall portion 41*a*, and a peripheral edge portion of the lateral extension portion 42*a* in the second peripheral wall portion 47, and a portion facing the lateral extension portion 42*a* in the sub cover 10.

As shown in FIGS. 14 and 17, the tray housing portion 12*a* can communicate with the tablet housing portion 11 via the communication port 50, and can communicate with an external space 300 via the takeout port 100. Thus, the tablets 200 housed in the tablet housing portion 11 can be supplied to the tray 20 in the tray housing portion 12*a* through the communication port 50, and the tablet 200 received in the tray 20 can be discharged to the external space 300 through the takeout port 100.

As shown in FIGS. 14 and 15, in the tray housing portion 12*a*, the tray 20 is sandwiched from both sides in the longitudinal direction Y by a portion along the edge portion on the upper side y1 of the lateral extension portion 42*a* in the second peripheral wall portion 47 and the first connecting wall portion 41*a*. Thus, the movement of the tray 20 in the longitudinal direction Y is restricted.

Thus, when the knob 13 rotates around the tubular shaft portion 42*c* extending in the thickness direction Z, the tray 20 connected to the knob 13 in the connecting shaft 90 as described above moves in a sliding manner in the lateral direction X in conjunction with the rotation of the knob 13.

As shown in FIG. 15, a stopper 55 protruding from the second peripheral wall portion 47 of the main body 6 to the lower side y2 is arranged on the left side x1 of the end portion on the upper side y1 of the tray 20. Due to the interference between the stopper 55 and the tray 20, the movement of the tray 20 to the left side x1 in the lateral direction X is restricted, whereby the falling off of the tray 20 from the tray housing portion 12*a* is suppressed.

Figure 16:
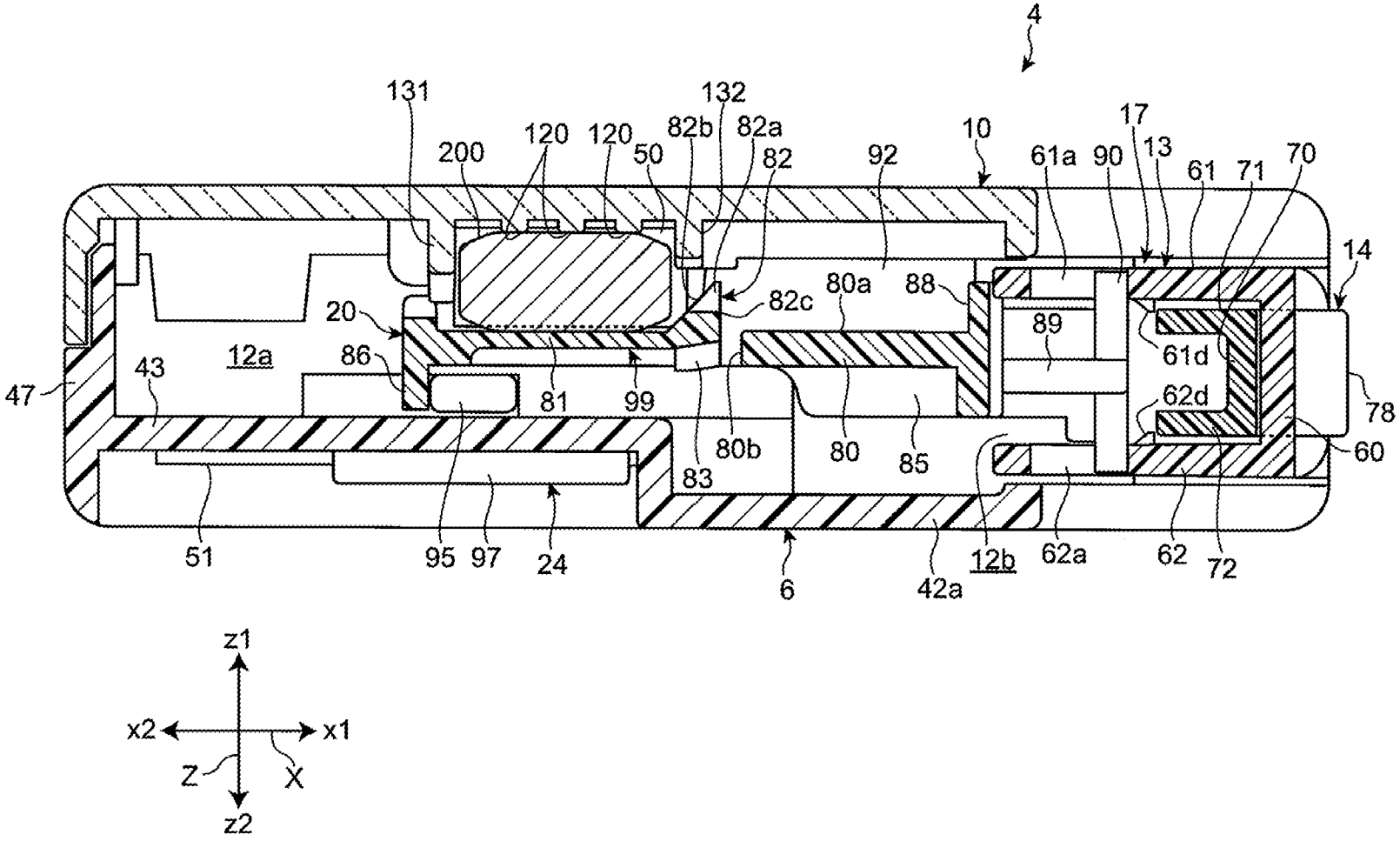
FIG. 16 is a cross-sectional view taken along line C-C in FIG. 6 when the inside of the second housing portion is viewed from the upper surface side.

As shown in FIGS. 16 and 17, the tray housing portion 12*a* includes a separation restriction portion 120 for restricting the tablet 200 from being separated from the placement surface 80*a* of the tray 20 to the front surface side z1 in the thickness direction Z.

The separation restriction portions 120 includes a rib-shaped portion protruding from the inner surface of the sub cover 10 (the surface on the back surface side z2). A plurality of separation restriction portions 120 are provided at intervals in the lateral direction X, and each of the separation restriction portions 120 is formed to extend in the longitudinal direction Y. The separation restriction portion 120 is arranged to overlap with the communication port 50 in the lateral direction X. The separation restriction portion 120 is arranged between the first wall portion 91 and the second wall portion 92 of the tray 20 in the longitudinal direction Y.

The separation restriction portion 120 is arranged to face the front surface side z1 in the thickness direction Z of the placement surface 80*a* of the tray 20. In the thickness direction Z, the space between the placement surface 80*a* and the separation restriction portion 120 is a space equal to or slightly larger than the thickness of the tablet 200. That is, the separation restriction portion 120 is arranged to face the tablet 200 on the placement surface 80*a* with substantially no gap. Thus, the tablet 200 sandwiched between the placement surface 80*a* and the separation restriction portion 120 is restricted in the movement in the thickness direction Z.

The tray housing portion 12*a* includes first and second slide restriction portions 131 and 132 for restricting the tablet 200 on the placement surface 80*a* from moving in a sliding manner in the lateral direction X.

The first and second slide restriction portions 131 and 132 include rib-shaped portions protruding from the inner surface of the sub cover 10 (the surface on the back surface side z2). Each of the first and second slide restriction portions 131 and 132 is formed so as to extend in the longitudinal direction Y.

Regarding the protrusion amount from the inner surface of the sub cover 10, the protrusion amounts of the first and second slide restriction portions 131 and 132 are larger than the protrusion amount of the separation restriction portion 120. The spaces between the placement surface 80*a* and the first and second slide restriction portions 131 and 132 in the thickness direction Z are smaller than the thickness of the tablet 200.

The first slide restriction portion 131 is arranged closer to the right side x2 in the lateral direction X than the plurality of separation restriction portions 120 are, and the second slide restriction portion 132 is arranged closer to the left side x1 in the lateral direction X than the plurality of separation restriction portions 120 are. The space between the first and the second slide restriction portions 131 and 132 in the lateral direction X is slightly larger than the width of one of the tablets 200 (the diameter of the tablet 200).

With respect to the tablet 200 on the placement surface 80*a*, the first slide restriction portion 131 is arranged adjacent to the right side x2 in the lateral direction X, and the second slide restriction portion 132 is arranged adjacent to the left side x1 in the lateral direction X. Thus, the tablets 200 on the placement surface 80*a* are caught from both sides in the lateral direction X by the first and second slide restriction portions 131 and 132, so that the movement in the lateral direction X is restricted.

[Slider]

Figure 13A:
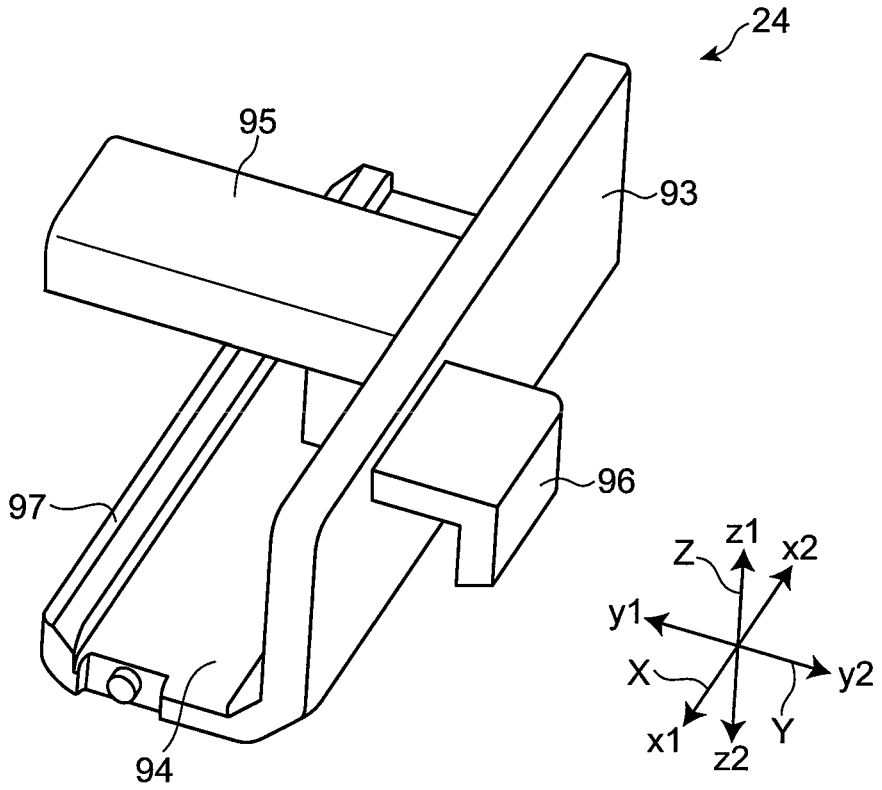
FIG. 13A is a first perspective view showing a slider.
Figure 13B:
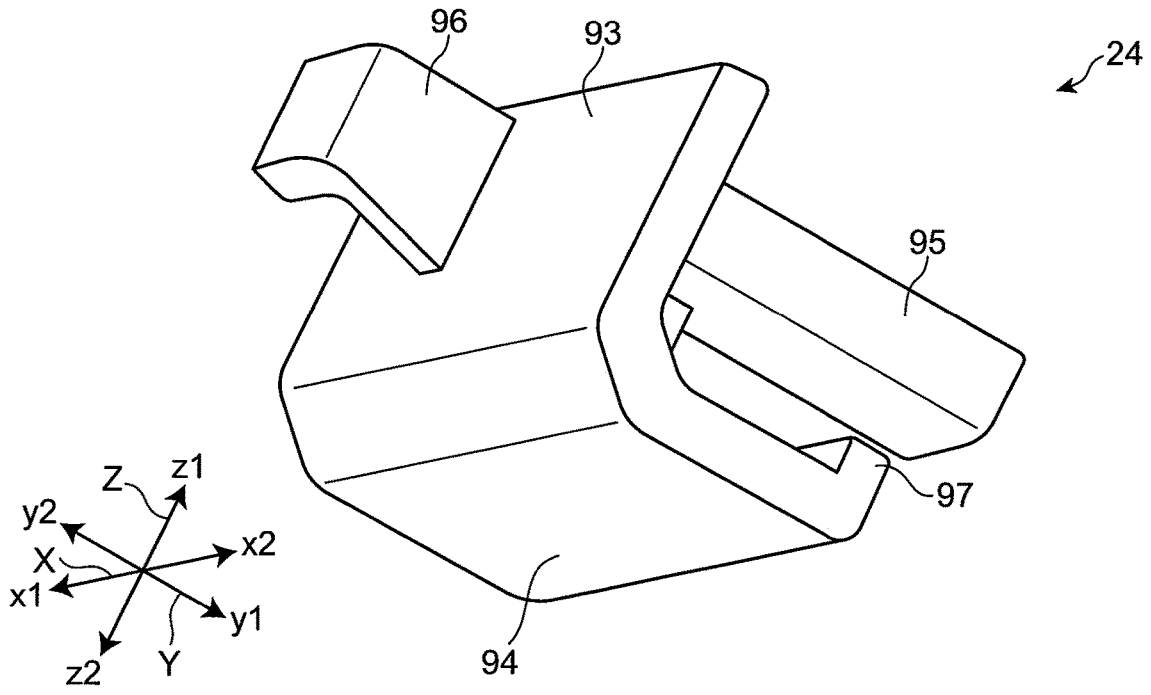
FIG. 13B is a second perspective view showing the slider.

FIGS. 13A and 13B show a slider 24 attached to the main body 6 so as to be slidable in the lateral direction X together with the tray 20 on which the tablet 200 is placed. The slider 24 constitutes a part of a detection mechanism for detecting the movement of the tray 20 in a state of engagement with the tray 20.

The slider 24 includes a first surface portion 93 arranged at a right angle to the longitudinal direction Y and a second surface portion 94 arranged at a right angle to the thickness direction Z. The first surface portion 93 is a rectangular-shaped plate portion having a pair of short sides extending in the thickness direction Z and a pair of long sides extending in the lateral direction X. The second surface portion 94 is a rectangular-shaped plate portion having a pair of short sides extending in the longitudinal direction Y and a pair of long sides extending in the lateral direction X.

The second surface portion 94 is provided so as to extend from the end portion on the back surface side z2 in the thickness direction Z of the first surface portion 93 to the upper side y1 in the longitudinal direction Y. Thus, the first surface portion 93 and the second surface portion 94 are connected to each other in an L shape.

The slider 24 further includes an engaging lever 95 extending from the first surface portion 93 to the upper side y1 in the longitudinal direction Y, a portion to be detected 96 protruding from the first surface portion 93 to the lower side y2 in the longitudinal direction Y, and a ridge portion 97 protruding from the second surface portion 94 to the front surface side z1 in the thickness direction Z.

The engaging lever 95 and the portion to be detected 96 are arranged to overlap with each other in the thickness direction Z. The portion to be detected 96 is arranged closer to the left side in the lateral direction X than the engaging lever 95 is. The ridge portion 97 is provided so as to extend in the lateral direction X along the edge portion on the upper side y1 in the longitudinal direction Y of the second surface portion 94.

As shown in FIGS. 15 and 17, the slider 24 is provided to penetrate the main body 6 so as to extend over the internal space of the second housing portion 12 and the module attached portion 53.

The first surface portion 93 of the slider 24 is arranged to face the lower side y2 in the longitudinal direction Y of the first connecting wall portion 41*a* of the main body 6, and the second surface portion 94 of the slider 24 is arranged to face the back surface side z2 in the thickness direction Z of the stage portion 43 of the main body 6. That is, the first surface portion 93 and the second surface portion 94 are arranged in the module attached portion 53 positioned outside the first housing portion 11 and the second housing portion 12.

A stopper 52 protruding from the first connecting wall portion 41*a* to the lower side y2 is arranged adjacent to the left side x1 of the first surface portion 93, whereby the movement to the left side x1 in the lateral direction X of the slider 24 is restricted.

The engaging lever 95 of the slider 24 passes through a guide hole 41*c* provided in the first connecting wall portion 41*a* to penetrate the first connecting wall portion 41*a*. Thus, the tip side portion of the engaging lever 95 is inserted into the tray housing portion 12*a* and supported on the stage portion 43. The guide hole 41*c* is an elongated hole extending in the lateral direction X, and the engaging lever 95 can move in a sliding manner in the lateral direction X within the length range of the guide hole 41*c*.

The ridge portion 97 of the slider 24 is engaged with a rail portion 51 protruding from the stage portion 43 to the back surface side z2 in the thickness direction Z. The rail portion 51 is provided so as to extend in the lateral direction X. The ridge portion 97 is engaged with the rail portion 51 from the upper side y1 in the longitudinal direction Y, whereby the slider 24 is suppressed from falling off from the main body 6.

The portion to be detected 96 of the slider 24 is arranged in the module attached portion 53. The portion to be detected 96 is detected whether it is positioned at a predetermined position in the lateral direction X by the sensor 33 of the electronic module 2 constituting the detection mechanism together with the slider 24. It should be noted that the type of the sensor 33 is not particularly limited, and for example, a contact type or optical type position sensor is used.

[Operation of Container]

In the following, the operation when the tablet 200 is taken out from the container 1 will be described with reference to cross-sectional views in FIGS. 14 to 20.

As shown in FIG. 15, in the non-operation state of the knob 13 and the lock lever 78, the upper surface portion 74 of the lock member 14 is arranged adjacent to the left side x1 in the lateral direction X of the stopper 55 of the main body 6.

In this state, if the knob 13 is to be pushed into the right side x2 (the left side in FIG. 15) without the lock lever 78 being operated, the upper surface portion 74 of the lock member 14 interferes with the stopper 55, so that the rotation of the knob 13 around the tubular shaft portion 42*c* is restricted. Thus, the rotation of the knob 13, that is, the operation of the movement mechanism 17 is locked by the lock member 14.

When the lock lever 78 is pushed down to the lower side y2 from the state shown in FIG. 15, the lock member 14 is moved to the lower side y2 in the longitudinal direction Y as a whole while contracting the return spring 16, and the upper surface portion 74 of the lock member 14 is arranged closer to the lower side y2 than the stopper 55 is. Thus, interference between the upper surface portion 74 and the stopper 55 is avoided, whereby the knob 13 is unlocked and the rotation of the knob 13, that is, the operation of the movement mechanism 17 becomes possible as shown in FIG. 19.

Figure 19:
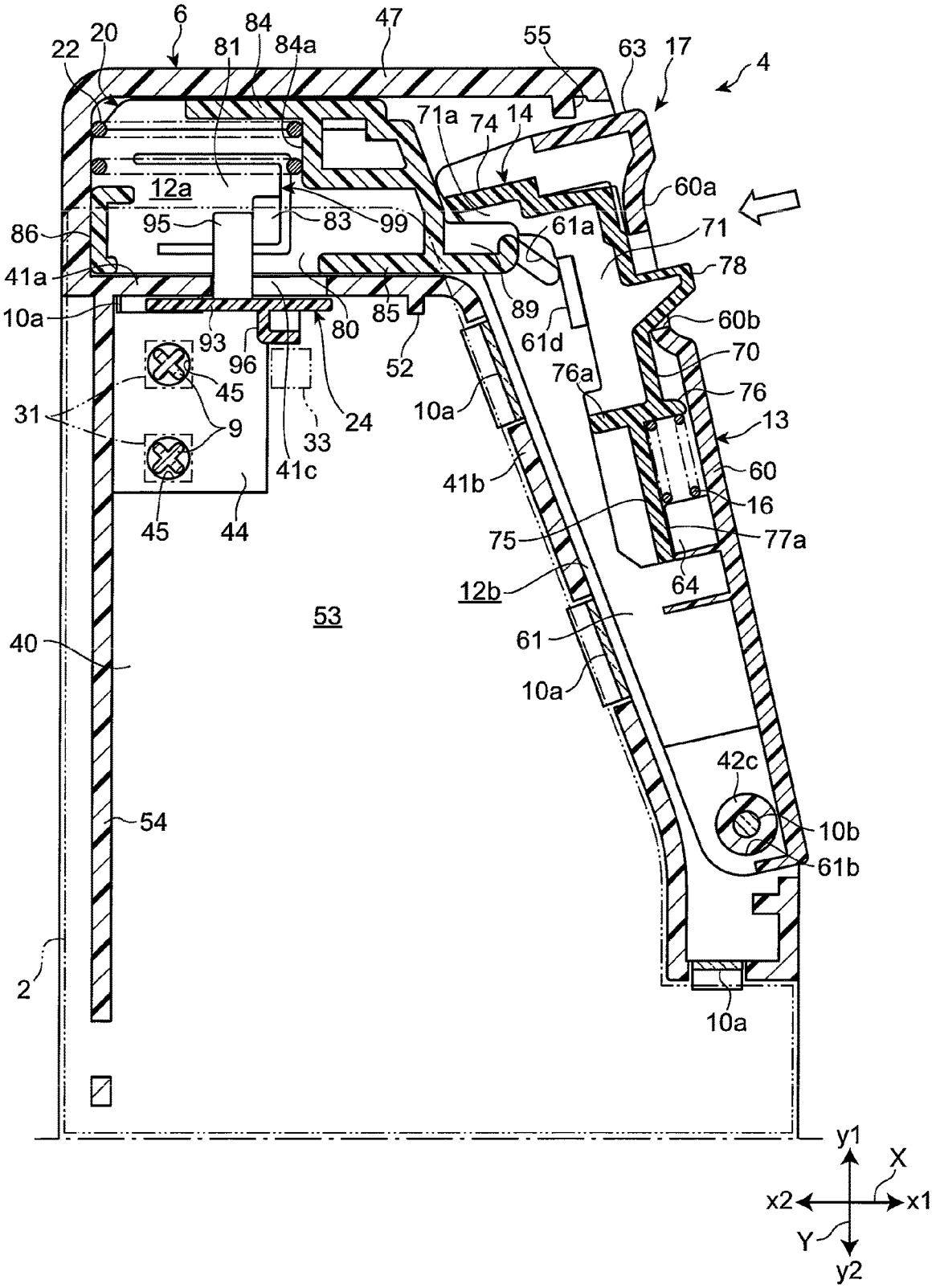
FIG. 19 is a cross-sectional view similar to FIG. 15 showing a state in which the tray has moved to the second position.
Figure 20:
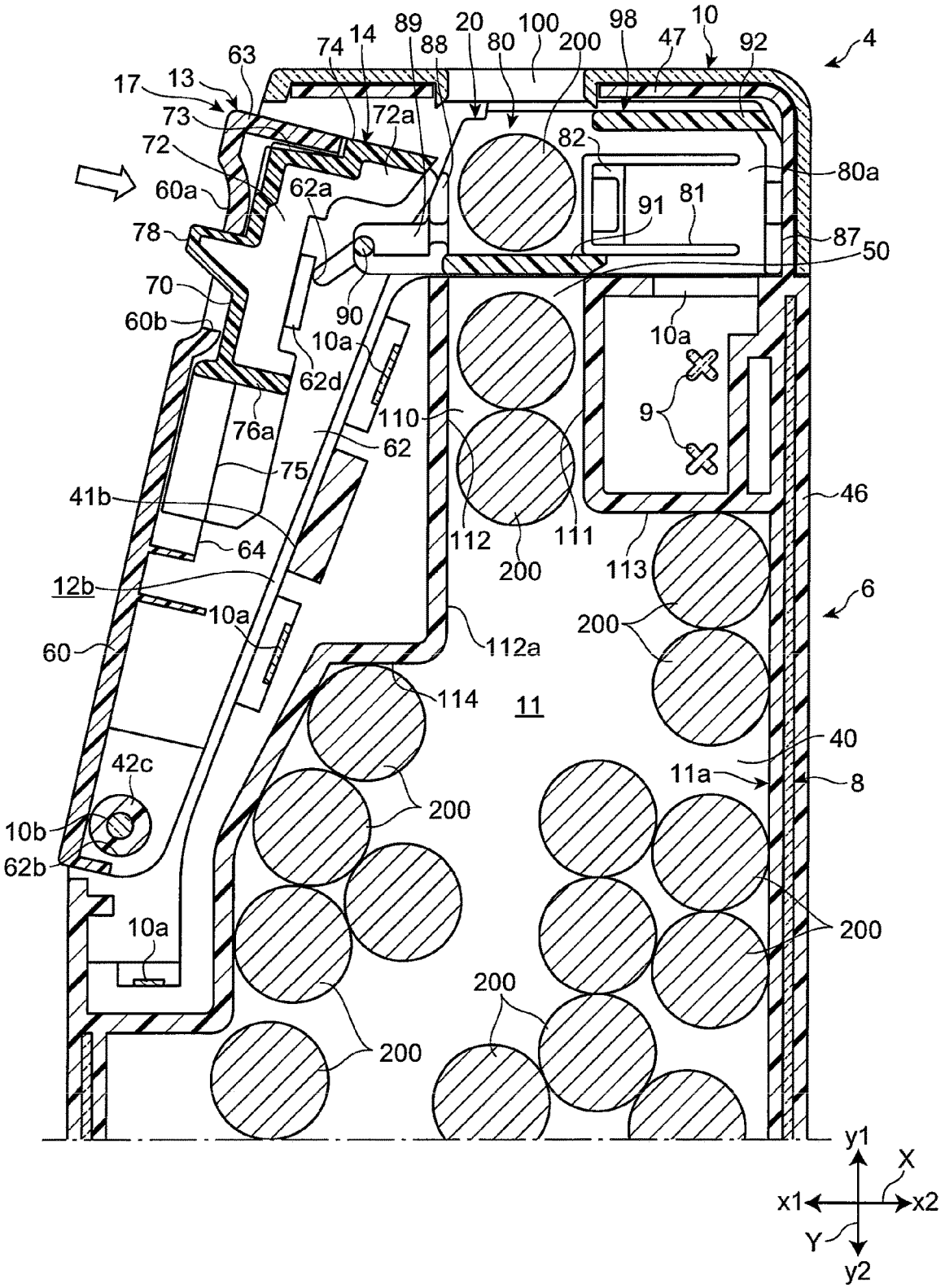
FIG. 20 is a cross-sectional view similar to FIG. 14 showing a state in which the tray has moved to the second position.

When the knob 13 is operated to rotate in this way, the tray 20 is moved forward in the lateral direction X from the first position shown in FIGS. 14 to 16 to the second position shown in FIGS. 19 and 20. The forward direction from the first position toward the second position is a direction toward the right side x2 in the lateral direction X.

As shown in FIG. 19, when the tray 20 is positioned in the second position, the return spring 22 constituting the movement mechanism 17 together with the knob 13 is contracted as compared with the case where the tray 20 is positioned in the first position (see FIG. 15). Thus, the urging force of the return spring 22 acting to the left side x1 in the lateral direction X on the portion to be urged 84*a* of the tray 20 is increased.

When the operation of the knob 13 is released, the tray 20 is retreated from the second position to the first position by the urging force of the return spring 22. The backward direction from the second position toward the first position is a direction toward the left side x1 in the lateral direction X.

At this time, in conjunction with the backward movement of the tray 20, the knob 13 rotates in a direction opposite to the direction during operation to be returned to the initial rotation angle position (see FIG. 15). It should be noted that releasing the operation of the lock lever 78 also pushes up the lock member 14 to the upper side y1 to the original position (see FIG. 15) with the urging force of the return spring 16.

As shown in FIG. 14, when the tray 20 is positioned in the first position, the communication port 50 between the tablet housing portion 11 and the tray housing portion 12*a* is opened without being blocked by the first wall portion 91 of the tray 20, and the takeout port 100 is blocked by the second wall portion 92 of the tray 20.

At this time, the tablets 200 in the tablet housing portion 11 can be supplied onto the tray 20 in the tray housing portion 12*a* through the opened communication port 50. As described above, the communication port 50 has such a size that the tablets 200 can pass through only one by one. In addition, the receiving portion 80 of the tray 20 has a size in which only one tablet 200 can be arranged in the longitudinal direction Y. Therefore, only one tablet 200 is reliably supplied to the tray 20. Thus, the second housing portion 12 can house only one tablet 200.

As shown in FIG. 17, in the thickness direction Z, the placement surface 80*a* of the tray 20 is arranged in the same position as compared with the position of the back surface side z2 edge portion of the communication port 50 or slightly in a position on the back surface side z2. Thus, the tablets 200 supplied from the tablet housing portion 11 to the tray housing portion 12*a* through the communication port 50 can be smoothly guided onto the placement surface 80*a* of the tray 20.

As shown in FIGS. 16 and 17, as described above, the tablets 200 placed on the placement surface 80*a* of the tray 20 are restricted in the movement to the front surface side z1 in the thickness direction Z by the separation restriction portion 120, and are restricted in the movement to the left side x1 and the right side x2 in the lateral direction X by the first and second slide restriction portions 131 and 132. Thus, when the tray 20 is moved in the lateral direction X by the movement mechanism 17, the tablet 200 placed on the receiving portion 80 of the tray 20 relatively moves in the lateral direction X with respect to the receiving portion 80.

In addition, when the tray 20 is positioned at the first position, since the takeout port 100 is blocked by the second wall portion 92 of the tray 20, the tablet 200 is prevented from going out of the takeout port 100.

As shown in FIGS. 14 and 16, the tablets 200 supplied onto the tray 20 positioned at the first position are first placed on the portion including the tongue-shaped portion 81 on the placement surface 80*a*. At this time, the first protruding portion 82 of the tongue-shaped portion 81 is arranged adjacent to the left side x1 of the tablet 200. The first protruding portion 82 protrudes toward the front surface side z1 with respect to the placement surface 80*a*.

Figure 18A:
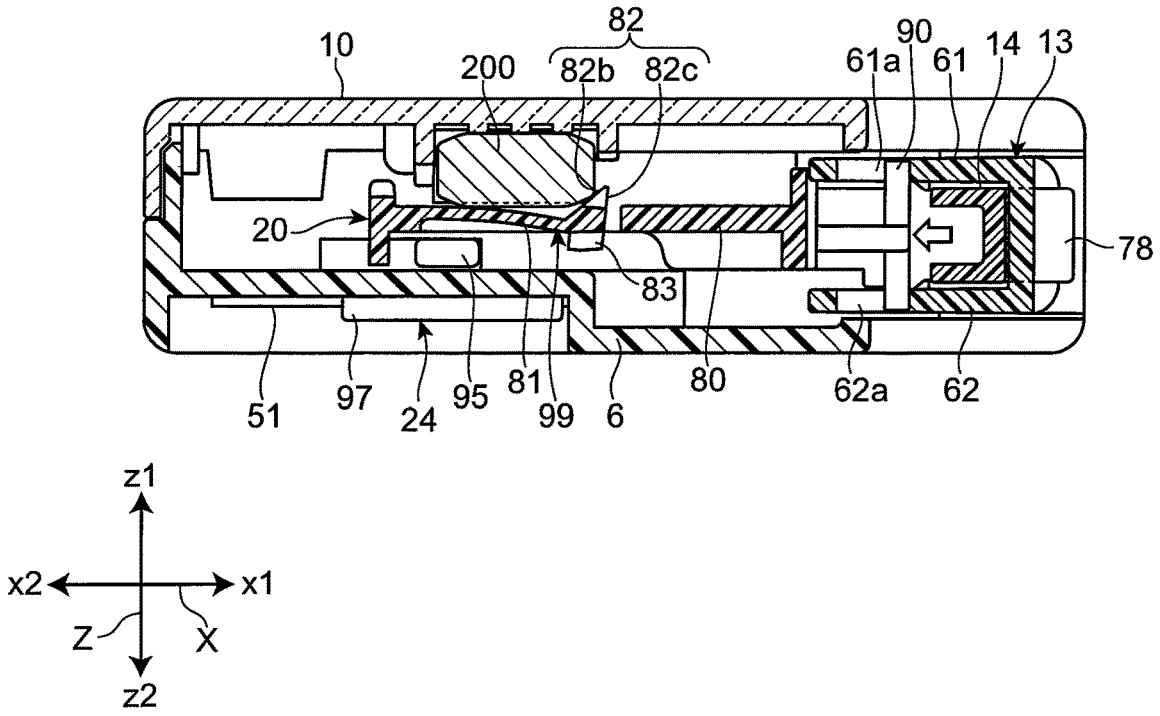
FIG. 18A is a cross-sectional view similar to FIG. 16 showing a state of a first stage in a process in which the tray moves from a first position to a second position.

As shown in FIG. 18A, when the tray 20 carrying the tablet 200 moves forward from the first position toward the second position to the right side x2, the tablet 200 on the tray 20 restricted in the movement in the lateral direction X abuts on the surface 82*b* on the right side x2 (the left side in FIG. 16) of the first protruding portion 82 of the tray 20.

As described above, the abutting surface 82*b* is an inclined surface inclined to the front surface side z1 toward the left side x1. Therefore, the tablet 200 abutting on the inclined surface 82*b* can smoothly relatively move backward to the left side x1 with respect to the tray 20 along the inclined surface 82*b*. Thus, the tablets 200 are suppressed from being caught by the first protruding portion 82 of the tray 20, so that the tray 20 can be smoothly moved forward.

When the tablet 200 on the tray 20 relatively moves backward with respect to the tray 20 in this way, the tablet 200 rides on the first protruding portion 82. Since the tablet 200 is restricted in the movement separated from the placement surface 80*a* to the front surface side z1, when the tablet 200 passes over the first protruding portion 82, the first protruding portion 82 of the tray 20 is pushed into the back surface side z2 by the tablet 200, whereby the tongue-shaped portion 81 is deformed to be bent so that at least the tip side portion thereof is pushed down to the back surface side z2. At this time, the second protruding portion 83 of the tongue-shaped portion 81 is displaced to the back surface side z2. This deformed state of the tongue-shaped portion 81 occurs only when the tablet 200 is placed.

Figure 18B:
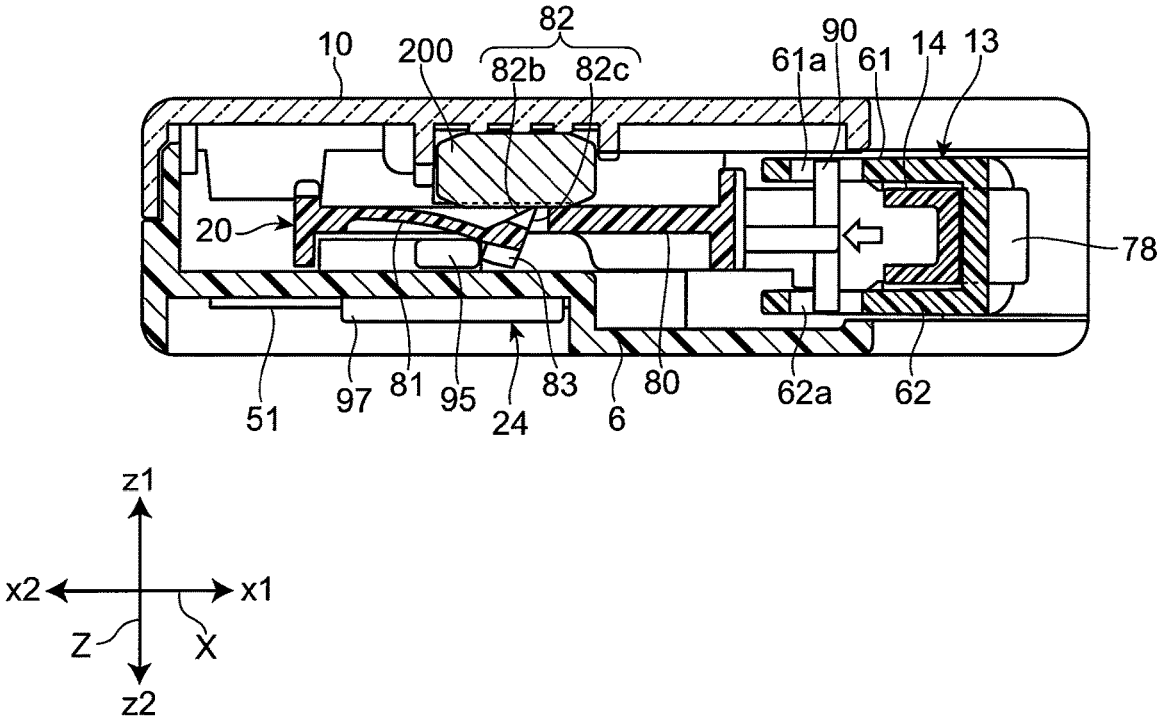
FIG. 18B is a cross-sectional view similar to FIG. 16 showing a state of a second stage in a process in which the tray moves from the first position to the second position.

As shown in FIG. 18B, when the tray 20 continues to move forward while maintaining the deformed state of the tongue-shaped portion 81, the second protruding portion 83 of the tongue-shaped portion 81 is engaged with the engaging lever 95 of the slider 24 from the left side x1. Thus, the engaging lever 95 of the slider 24 can be interlocked with the operation of moving the tray 20 by the opening and closing mechanism 98. In this interlocked state, the engaging lever 95 is pushed into the right side x2 in the lateral direction X by the second protruding portion 83 of the tray 20, resulting in moving to the right side x2 in the lateral direction X. Thus, the slider 24 moves forward together with the tray 20.

Figure 18C:
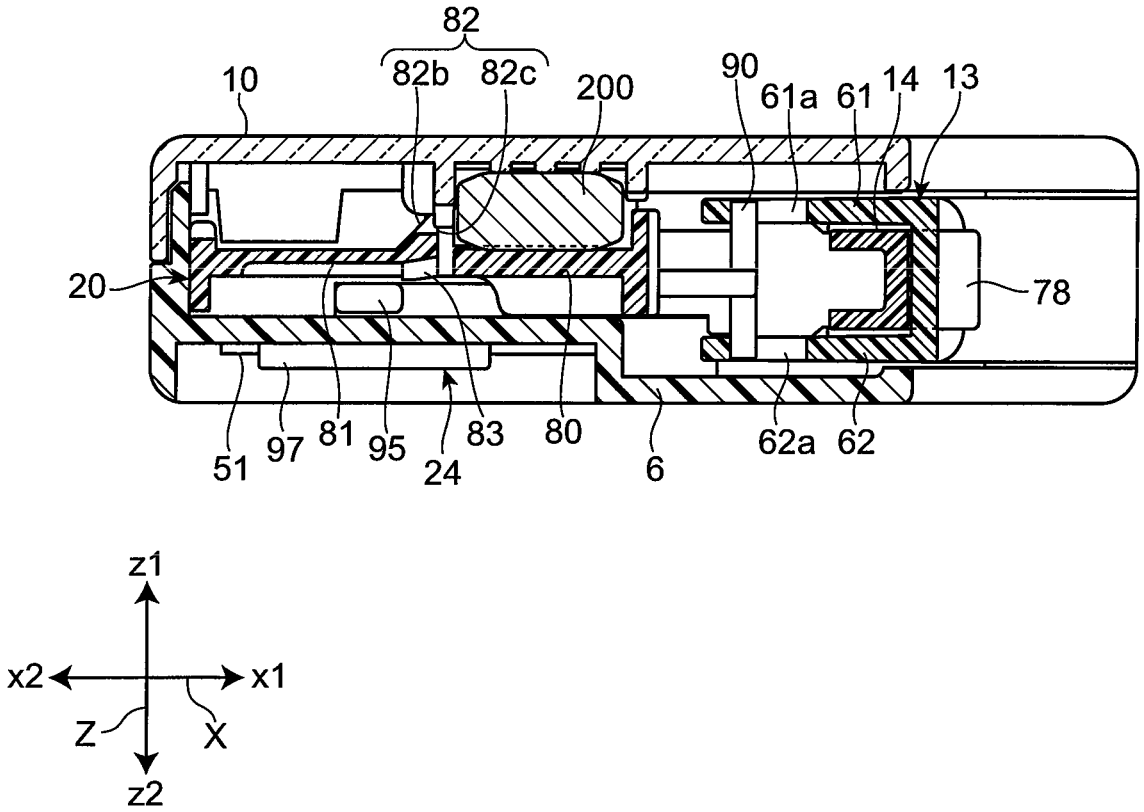
FIG. 18C is a cross-sectional view similar to FIG. 16 showing a state of a third stage in a process in which the tray moves from the first position to the second position.

As shown in FIG. 18C, when the tray 20 reaches the second position, the tablet 200 rides over the first protruding portion 82 of the tongue-shaped portion 81 of the tray 20 and is placed on a portion closer to the left side x1 than the first protruding portion 82 on the placement surface 80*a* is.

In addition, at this time, the tongue-shaped portion 81 released from the engagement with the tablet 200 is restored to its original shape. Furthermore, at this time, the second protruding portion 83 of the tongue-shaped portion 81 returned to the original position in the thickness direction Z is released from engagement with the engaging lever 95 of the slider 24.

When the slider 24 is moved forward to the position in the lateral direction X where the engagement with the tray 20 is released, it is detected by the sensor 33 of the electronic module 2 (see FIG. 19) that the portion to be detected 96 of the slider 24 is positioned in the position in the lateral direction X corresponding to this position. Based on the detection by the sensor 33, it can be checked that the tray 20 is positioned at the second position.

As shown in FIG. 20, when the tray 20 is positioned at the second position, the takeout port 100 is opened without being blocked by the second wall portion 92 of the tray 20, and the tablet 200 can be taken out from the takeout port 100. Therefore, it is presumed that the tablet 200 on the tray 20 is taken out from the takeout port 100 to be dosed when the detection by the sensor 33 is performed.

At this time, based on the detection signal of the sensor 33, the light emitting portion 31 (see FIG. 19) may be turned off, and the notification unit 18 (see FIG. 4) may stop the notification of the dosage time.

On the other hand, in the state where the tablet 200 is not placed on the tray 20, even if the tray 20 moves forward in conjunction with the rotation operation of the knob 13, the tip of the tongue-shaped portion 81 of the tray 20 is not pushed down to the back surface side z2 by the tablet 200 (see FIG. 18). Therefore, since the second protruding portion 83 of the tongue-shaped portion 81 and the engaging lever 95 of the slider 24 do not engage, the slider 24 does not move forward together with the tray 20.

As described above, in the present embodiment, the tongue-shaped portion 81 functions as a switch mechanism 99 for switching between the interlocked state and the non-interlocked state between the tray 20 (the opening and closing mechanism 98) and the engaging lever 95 (the slider 24) according to the presence or absence of the tablet 200 on the tray 20. According to the switch mechanism 99, only in a state where the tablet 200 is placed on the tray 20, the tongue-shaped portion 81 is brought into the above deformed state, and the tray 20 and the engaging lever 95 are in an interlocked state via the tongue-shaped portion 81 in the deformed state. Therefore, the detection by the sensor 33 (see FIG. 19) is not performed unless the tablet 200 is placed on the tray 20. Therefore, it can be prevented from being erroneously detected that the tablet 200 can be taken out although the tablet 200 cannot be taken out from the takeout port 100.

In addition, as shown in FIG. 20, when the tray 20 is moved to the second position, the communication port 50 is blocked by the second wall portion 92 of the tray 20. Thus, the tablet 200 on the tray 20 is isolated from the other tablets 200 housed in the tablet housing portion 11, and the supply of further solid material from the tablet housing portion 11 to the tray housing portion 12*a* is blocked. Therefore, when the tray 20 is positioned at the second position, it is possible to prevent a plurality of tablets 200 from coming out continuously from the takeout port 100.

As shown in FIG. 18C, if the tray 20 is to move backward to the left side x1 (the right side in FIG. 18) in a state in which the tablet 200 is kept to be placed on the tray 20 positioned at the second position, the surface 82*c* on the left side x1 (the right side in FIG. 18) of the first protruding portion 82 of the tray 20 is caught by the tablet 200 restricted in the movement in the lateral direction X.

At this time, since the communication port 50 is blocked by the first wall portion 91 of the tray 20, the tablet 200 on the tray 20 is not returned to the tablet housing portion 11. Therefore, unless the tablet 200 is taken out from the takeout port 100, the tray 20 cannot return to the first position.

Therefore, once the tray 20 placing the tablet 200 is moved to the second position, the container 1 cannot be continuously used unless the tablet 200 on the tray 20 is taken out. Thus, since it is prompted that the tablet 200 is taken out from the takeout port 100, when the detection by the sensor 33 (see FIG. 19) is made, it can be presumed that the tablet 200 is reliably taken out. In addition, as described above, since the plurality of tablets 200 are prevented from being continuously taken out, only one tablet is reliably taken out during detection by the sensor 33.

Therefore, when the period of time or the number of times of dosage of the tablet 200, or the remaining number of tablets 200 in the container 1 is managed based on the detection by the sensor 33, the management of these can be performed with high accuracy.

In addition, according to the present embodiment, the following effects can be further obtained.

As described above, since the communication port 50 and the takeout port 100 are arranged to face each other, the tablet 200 supplied from the tablet housing portion 11 onto the tray 20 in the tray housing portion 12*a* through the communication port 50 is arranged between the communication port 50 and the takeout port 100. The arrangement of the tablet 200 is maintained even when the tray 20 is moved to the second position. Therefore, when the tray 20 is moved to the second position and the takeout port 100 is opened, it is possible to smoothly take out the tablet 200 remaining at the position between the communication port 50 and the takeout port 100 from the takeout port 100.

In addition, at this time, since the tray 20 is kept to be housed in the tray housing portion 12*a* without being exposed to the external space 300, the sanitary conditions of the tray 20 can be easily maintained favorably.

Furthermore, when the tray 20 is positioned at the second position, since the communication port 50 is blocked, it can be prevented that the tablet 200 once taken out from the takeout port 100 is returned to the tablet housing portion 11, or a foreign matter is mixed in the tablet housing portion 11.

In addition, according to the container 1 of the present embodiment, even without providing a plurality of partitions for individually housing the tablets 200 or even without providing an alignment mechanism for selectively aligning any one partition of the partitions to the takeout port 100, the tablets 200 can be reliably taken out one by one, so that the configuration of the container 1 can be simplified.

The present invention has been described above by giving the above embodiment, but is not limited to the above embodiment.

For example, in the above embodiment, the example in which the surface 82*c* on the left side x1 (back side in the tray forward direction) in the first protruding portion 82 is a surface at a right angle to the lateral direction X (non-inclined surface with respect to the tray forward direction) is described, but the surface 82*c* may be an inclined surface inclined to the same side as the surface 82*b* on the right side x2 (the front side in the tray forward direction) of the first protruding portion 82, or may be an inclined surface inclined opposite from the surface 82*b* on the right side x2 (the front side in the tray forward direction) and having a steeper slope than that of the surface 82*b*, which can also restrict the tray 20 placing the tablet 200 from returning from the second position to the first position.

In addition, in the above embodiment, the opening and closing mechanism 98 is configured to open and close the takeout port 100 and the communication port 50 by operating the first wall portion 91 and the second wall portion 92 due to the movement of the tray 20, but in the present invention, the configuration of the opening and closing mechanism 98 may adopt various configurations as long as the first wall portion 91 and the second wall portion 92 are relatively operated with respect to the takeout port 100 and the communication port 50. For example, as a modified example of the opening and closing mechanism, it may be configured that the takeout port 100 and the communication port 50 are operated by any means in a state where the first wall portion 91 and the second wall portion 92 are stationary, leading to the takeout port 100 and the communication port 50 being opened and closed.

Furthermore, in the above embodiment, the configuration of moving the tray 20 (the first wall portion 91 and the second wall portion 92) while restricting the movement of the tablet 200 is described, but in the present invention, when the first wall portion 91 and the second wall portion 92 are maintained in a stationary state, means for moving the tablets 200 may be provided.

Still furthermore, in the above embodiment, an example in which the first wall portion 91 and the second wall portion 92 are integrated to form a part of the tray 20 is described, but in the present invention, the first wall portion 91 and the second wall portion 92 may be formed separately.

In addition, in the above embodiment, an example in which the entire shape of the container 1 is a rectangular shape is described, but in the present invention, the entire shape of the container 1 is not particularly limited.

Furthermore, in the above embodiment, the present invention is described by taking the container 1 housing the tablets 200 as an example, but the solid materials housed in the container according to the present invention are not limited to tablets, and may be capsules, for example.

INDUSTRIAL APPLICABILITY

As described above, according to the present invention, it is possible to provide a container the configuration of which can be simplified and from which solid materials such as tablets can be reliably taken out one by one, so that the present invention may be suitably used for the manufacturing industry of this type of container.

DESCRIPTION OF REFERENCE SYMBOLS

1 CONTAINER
2 ELECTRONIC MODULE
4 CONTAINER MAIN BODY
6 MAIN BODY
8 MAIN COVER
9 LIGHT GUIDE PORTION
10 SUB COVER
11 TABLET HOUSING PORTION (FIRST HOUSING PORTION)
11*a* PERIPHERAL WALL
12 COMPONENT HOUSING PORTION (SECOND HOUSING PORTION)
12*a* TRAY HOUSING PORTION
12*b* KNOB HOUSING PORTION
13 KNOB
14 LOCK MEMBER
17 MOVEMENT MECHANISM
18 NOTIFICATION UNIT
20 TRAY
22 RETURN SPRING
24 SLIDER
26 MOVEMENT MECHANISM
31 LIGHT EMITTING PORTION
33 SENSOR
40 MAIN PLATE PORTION
42 SUB PLATE PORTION
42*c* TUBULAR SHAFT PORTION
43 STAGE PORTION
46 FIRST PERIPHERAL WALL PORTION
47 SECOND PERIPHERAL WALL PORTION
50 COMMUNICATION PORT
53 MODULE ATTACHED PORTION
78 LOCK LEVER
80 RECEIVING PORTION
80*a* PLACEMENT SURFACE
80*b* THROUGH HOLE
81 TONGUE-SHAPED PORTION (DEFORMATION PORTION)
82 FIRST PROTRUDING PORTION
82*b* SURFACE ON THE RIGHT SIDE (SURFACE ON THE FRONT SIDE)
82*c* SURFACE ON THE LEFT SIDE (SURFACE ON THE BACK SIDE)
83 SECOND PROTRUDING PORTION
84*a* PORTION TO BE URGED
90 CONNECTING SHAFT
91 FIRST WALL PORTION
92 SECOND WALL PORTION
95 ENGAGING LEVER (ENGAGING PORTION)
96 PORTION TO BE DETECTED
98 OPENING AND CLOSING MECHANISM
99 SWITCH MECHANISM
100 TAKEOUT PORT

110 PASSAGE
111 FIRST GUIDE SURFACE PORTION
112 SECOND GUIDE SURFACE PORTION
113 THIRD GUIDE SURFACE PORTION
114 FOURTH GUIDE SURFACE PORTION
120 SEPARATION RESTRICTION PORTION
131 FIRST SLIDE RESTRICTION PORTION
132 SECOND SLIDE RESTRICTION PORTION
200 TABLET (SOLID MATERIAL)
300 EXTERNAL SPACE

The invention claimed is:

1. A container comprising:

a first housing portion configured to house a plurality of solid materials;

a second housing portion configured to communicate with the first housing portion via a predetermined communication port and to be configured to communicate with an external space via a predetermined takeout port, wherein the communication port and the takeout port are arranged to face each other;

a tray housed in the second housing portion, the tray including:

a receiving portion configured to receive one of the solid materials supplied from the first housing portion to the second housing portion, a first wall portion configured to block the communication port, and a second wall portion configured to block the takeout port, wherein the second housing portion is provided with a slide restriction portion configured to restrict the solid material on the receiving portion from moving in a sliding manner in a sliding direction of the tray;

a movement mechanism configured to move the tray in a sliding manner between a first position in which the communication port is opened and the takeout port is blocked by the second wall portion and a second position in which the communication port is blocked by the first wall portion and the takeout port is opened in the second housing portion, wherein the receiving portion is provided with a deformation portion brought into a predetermined deformed state only in a case where the solid material is placed when the tray moves in a forward direction from the first position to the second position, and a slider including an engaging portion to be engaged with the deformation portion only in a case where the deformation portion is in the deformed state when the tray moves in the forward direction, the slider being moved in a sliding manner in the forward direction together with the tray in an engaged state of the engaging portion and the deformation portion.

2. The container according to claim 1, wherein the deformation portion is a tongue-shaped portion extending in a backward direction from the second position toward the first position with a predetermined portion of the receiving portion as a base end to have a tip as a free end, wherein the second housing portion includes a separation restriction portion arranged to face a placement surface of the solid material in the receiving portion to restrict the solid material from moving in a direction of separating from the placement surface, and wherein, in a state where the solid material is placed on the tray positioned at the first position, the tongue-shaped portion is provided with a first protruding portion protruding toward the separation restriction portion with respect to the placement surface at a position adjacent to the solid material in the backward direction, and a second protruding portion to be engaged with the slider in the deformed state of the tongue-shaped portion, the second protruding portion protruding opposite from the first protruding portion.

3. The container according to claim 2, wherein a surface on a front side in the forward direction in the first protruding portion is an inclined surface inclined to a side of the separation restriction portion toward a back side in the forward direction.

4. The container according to claim 3, wherein a surface on a back side in the forward direction in the first protruding portion is a non-inclined surface with respect to the forward direction, an inclined surface inclined to a side identical to a side of a surface on the front side, or an inclined surface inclined opposite from the surface on the front side and having a steeper slope than the surface on the front side.

5. The container according to claim 1, wherein each of the solid materials is a tablet having a flat shape, wherein a dimension in a thickness direction of the tablet in an internal space of the first housing portion is smaller than a thickness of two of the tablets, wherein a peripheral wall of the first housing portion includes a pair of guide surface portions extending parallel to each other from a peripheral edge portion of the communication port, and wherein a space between the pair of guide surface portions is larger than a width of one of the tablets and smaller than a width of two tablets.

6. The container according to claim 5, wherein the pair of guide surface portions are respectively a first guide surface portion and a second guide surface portion extending in a supplying direction of the tablet to the communication port, and wherein the second guide surface portion is formed to be longer than the first guide surface portion in the supplying direction.

7. The container according to claim 6, wherein a peripheral wall of the first housing portion further includes:

a third guide surface portion extending in a direction at a right angle to the supplying direction from a base end in the supplying direction of the first guide surface portion toward a side opposite to a side of the second guide surface portion, and a fourth guide surface portion extending in the direction at a right angle from a base end in the supplying direction of the second guide surface portion toward a side opposite to a side of the first guide surface portion.

8. A container comprising:

a first housing portion configured to house a plurality of solid materials;

a second housing portion provided to be configured to communicate with the first housing portion via a predetermined communication port and to be configured to communicate with an external space via a predetermined takeout port, the second housing portion being configured to house one of the solid materials;

an opening and closing mechanism including a first wall portion configured to block the communication port and a second wall portion configured to block the takeout port, the opening and closing mechanism being configured to block the takeout port with the second wall portion when the first wall portion opens the communication port, the opening and closing mechanism being configured to block the communication port with the first wall portion when the second wall portion opens the takeout port;

a lever configured to perform a predetermined operation in an interlocked state with an operation of opening the takeout port by the opening and closing mechanism; and a switch mechanism configured to interlock the opening and closing mechanism and the lever only in a state in which the solid material is housed in the second housing portion.

9. The container according to claim 8, further comprising a receiving portion on which the solid material is placed in the second housing portion, wherein the receiving portion includes a deformation portion configured to be deformed into a predetermined deformed state only in a state where the solid material is placed, and wherein the switch mechanism interlocks the opening and closing mechanism and the lever via the deformation portion in the deformed state.

10. The container according to claim 9, wherein the opening and closing mechanism includes a movement mechanism configured to relatively moves the solid material placed on the receiving portion with respect to the receiving portion in conjunction with an operation of opening the takeout port, wherein a protruding portion is provided on a surface on which the solid material is placed in the deformation portion, and wherein the deformed state is a state in which at least a part of the deformation portion is displaced in a direction opposite to a protruding direction of the protruding portion when the solid material during the relative movement passes over the protruding portion.

11. The container according to claim 1, wherein, in a process where the tray supporting the solid material moves from the first position to the second position, the solid material forms the first protruding portion of the deformation portion to bring the second protruding portion into a position where the second protruding portion is capable of being engagement with the slider as the tray moves in a direction from the first position toward the second position;

wherein, in the process where the tray moves from the first position to the second position, the second protruding portion engages with the slider to move the slider in the direction from the first position toward the second position; and wherein, when the tray reaches the second position, the second protruding position disengages from the slider to bring the deforming portion into a non-deformed original position.

12. The container of claim 11, further comprising a sensor for detecting the slider, wherein the sensor does not detect the slider when the tray is in the first position, and wherein the sensor detects the slider only when the tray is in the second position and supports the solid material.

13. The container of claim 12, wherein, when the tray does not supporting the solid material as the tray moves from the first position to the second position, the deforming portion maintains an un-deformed position; the second protruding portion disengages with the slider; and the sensor does not detect the slider.

* * * * *